US010077926B2

(12) United States Patent
Kim et al.

(10) Patent No.: US 10,077,926 B2
(45) Date of Patent: Sep. 18, 2018

(54) AIR CONDITIONER AND EVAPORATOR INLET HEADER DISTRIBUTOR THEREFOR

(71) Applicant: LG ELECTRONICS INC., Seoul (KR)

(72) Inventors: Hongseong Kim, Changwon-si (KR); Sangyeul Lee, Changwon-si (KR); Inbeom Cheon, Changwon-si (KR); Hanchoon Lee, Changwon-si (KR); Juhyok Kim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 119 days.

(21) Appl. No.: 15/150,804

(22) Filed: May 10, 2016

(65) Prior Publication Data

US 2016/0252282 A1 Sep. 1, 2016

Related U.S. Application Data

(62) Division of application No. 14/064,459, filed on Oct. 28, 2013.

(30) Foreign Application Priority Data

Nov. 2, 2012 (KR) ..... 10-2012-0123703
Nov. 2, 2012 (KR) ..... 10-2012-0123704
Nov. 2, 2012 (KR) ..... 10-2012-0123705

(51) Int. Cl.
*F25B 41/06* (2006.01)
*F25B 13/00* (2006.01)
(Continued)

(52) U.S. Cl.
CPC ..... *F25B 41/06* (2013.01); *F25B 13/00* (2013.01); *F25B 39/028* (2013.01); *F28F 9/026* (2013.01);
(Continued)

(58) Field of Classification Search
CPC ..... F25B 39/028; F25B 2400/23; F28F 9/026; F28F 9/0275
(Continued)

(56) References Cited

U.S. PATENT DOCUMENTS 2,063,380 A * 12/1936 Hoesel ..... F25B 39/028 62/512
2,084,755 A * 6/1937 Young, Jr. ..... F25B 39/028 137/561 A
(Continued)

OTHER PUBLICATIONS

U.S. Office Action issued in co-pending U.S. Appl. No. 14/064,459 dated Sep. 18, 2015.
(Continued)

*Primary Examiner* — Christopher R Zerphey
(74) *Attorney, Agent, or Firm* — KED & Associates LLP

(57) ABSTRACT

An air conditioner and evaporator inlet header distributor therefor are provided. The air conditioner may include an evaporator inlet header distributor to distribute a refrigerant expanded in an expansion mechanism to a plurality of refrigerant flow paths of an evaporator. The evaporator inlet header distributor may include a distributor body, a refrigerant inlet pipe to guide refrigerant expanded in the expansion mechanism to an inside of the distributor body, a plurality of refrigerant outlet pipes to discharge the refrigerant from the distributor body into the plurality of refrigerant flow paths, and a separating plate to separate the inside of the distributor body into a header flow path connected with the plurality of refrigerant outlet pipes and a refrigerant dispersing flow path connected with the refrigerant inlet pipe to guide an upper portion and a lower portion of the header flow path by dispersing the refrigerant. Accordingly, two-phase refrigerant may be uniformly distributed to the plurality of refrigerant outlet pipes using a simple structure.

20 Claims, 10 Drawing Sheets

(51) Int. Cl.
*F25B 39/02* (2006.01)
*F28F 9/02* (2006.01)
*F28D 21/00* (2006.01)

(52) U.S. Cl.
CPC .... *F28F 9/0265* (2013.01); *F28D 2021/0071* (2013.01); *F28F 2250/00* (2013.01)

(58) Field of Classification Search
USPC ..... 62/525
See application file for complete search history.

(56) References Cited

U.S. PATENT DOCUMENTS

| | | | | | |
|---|---|---|---|---|---|
| 2,196,858 | A | * | 4/1940 | Gleason | F25B 39/028 137/262 |
| 2,220,595 | A | * | 11/1940 | Andersen | F25B 39/028 137/262 |
| 2,229,940 | A | * | 1/1941 | Spofford | F25B 39/028 165/176 |
| 3,795,259 | A | | 3/1974 | Brandin et al. | |
| 4,922,732 | A | | 5/1990 | Eriksson | |
| 6,688,137 | B1 | | 2/2004 | Gupte | |
| 7,044,200 | B2 | | 5/2006 | Gupte et al. | |
| 8,281,615 | B2 | | 10/2012 | Tucker et al. | |
| 2010/0206535 | A1 | | 8/2010 | Munoz et al. | |

OTHER PUBLICATIONS

U.S. Final Office Action issued in co-pending U.S. Appl. No. 14/064,459 dated Feb. 11, 2016.

* cited by examiner

AIR CONDITIONER AND EVAPORATOR INLET HEADER DISTRIBUTOR THEREFOR

CROSS-REFERENCE TO RELATED APPLICATION(S)

This application is a Divisional Application of U.S. patent application Ser. No. 14/064,459 filed on Oct. 28, 2013, which claims the benefit of Korean Application Nos. 10-2012-0123703, 10-2012-0123704, and 10-2012-0123705, filed in Korea on Nov. 2, 2012, the subject matter of each of which is incorporated herein by reference.

BACKGROUND

1. Field

An air conditioner and an evaporator inlet header distributor therefor are disclosed herein.

2. Background

Air conditioners and distributors therefor are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
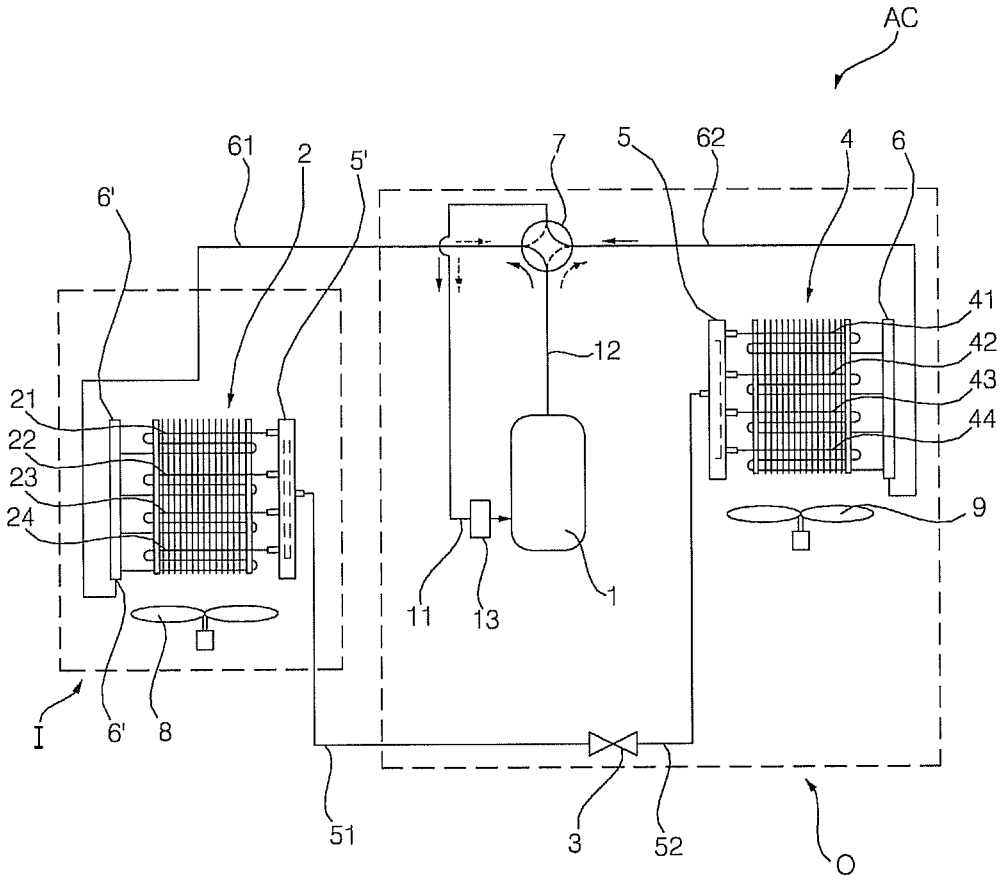
FIG. 1 is a schematic diagram of an air conditioner according to an embodiment.

Embodiments will be described with reference to appended drawings. Where possible, like names and reference numerals have been used to indicate like or similar elements, and repetitive description has been omitted.

In general, an air conditioner is a device that cools or heats an indoor space using a refrigerant cycle during which a refrigerant is circulated and may be sequentially compressed, condensed, expanded, and evaporated. Cooling and heating functions may be performed by suctioning ambient heat when vaporizing the refrigerant and discharging heat when liquefying the refrigerant.

The air conditioner may include a compressor, a condenser, an expansion mechanism, and an evaporator to circulate the refrigerant. The refrigerant passing through the expansion mechanism may flow into the evaporator in a state of a two-phase refrigerant including gaseous refrigerant and liquid refrigerant. One refrigerant flow path may be formed in the evaporator, or a plurality of refrigerant flow paths may be formed. In such an air conditioner, if the evaporator is configured to have a plurality of refrigerant flow paths, the two-phase refrigerant having flowed into the expansion mechanism may be distributed to the plurality of refrigerant flow paths, such that the refrigerant may be evaporated in each refrigerant flow path and thereafter flow to the compressor.

In conventional air conditioners, liquid refrigerant may be excessively introduced into a portion of the plurality of refrigerant flow paths of the evaporator, and the efficiency of the evaporator may be degraded due to variations in the amount of liquid refrigerant in the plurality of refrigerant flow paths.

FIG. 1 is a schematic diagram of an air conditioner according to an embodiment. The air conditioner AC of FIG. 1 may include a compressor 1, a first heat exchanger 2, an expansion mechanism 3, and a second heat exchanger 4. The air conditioner may be an air conditioner that only cools an indoor space using a refrigerant, or a two-way air conditioner that cools and heats the indoor space using a refrigerant.

If the air conditioner is an air conditioner that only cools, the refrigerant compressed in the compressor 1 may be suctioned by the compressor 1 after the refrigerant is sequentially passed through the second heat exchanger 4, the expansion mechanism 3, and the first heat exchanger 2; the second heat exchanger 4 may be an outdoor heat exchanger to heat-exchange the outdoor air or a coolant and may be a condenser to condense the refrigerant compressed in the compressor 1, and the first heat exchanger 2 may be an indoor heat exchanger to heat-exchange the indoor air with the refrigerant and may be an evaporator to evaporate the refrigerant expanded in the expansion mechanism 3. Further, an evaporator inlet header distributor 5' may be installed between the expansion mechanism 3 and the first heat exchanger 2, and the evaporator inlet header distributor 5' may distribute the refrigerant expanded in the expansion mechanism 3 to the first heat exchanger 2.

A plurality of refrigerant flow paths may be formed in the second heat exchanger 4, a condenser inlet branch portion (not shown) may be installed between the first compressor 1 and the second heat exchanger 4, and a condenser outlet combined portion (not shown) may be installed between the second heat exchanger 4 and expansion mechanism 3. The condenser inlet branch portion may uniformly distribute the gaseous refrigerant compressed in the compressor 1 to the plurality of refrigerant flow paths of the second heat exchanger 4. The refrigerant condensed in the plurality of refrigerant flow paths of the second heat exchanger 4 may be combined in a condenser outlet combined portion (not shown), and then, may flow into the expansion mechanism 3.

A plurality of refrigerant flow paths may be formed in the first heat exchanger 2, the evaporator inlet header distributor 5' may be installed between the expansion mechanism 3 and the first heat exchanger 2, and an evaporator outlet header pipe 6' may be installed between the first heat exchanger 2 and the compressor 1. The evaporator inlet header distributor 5' may uniformly distribute the gaseous refrigerant and the liquid refrigerant to the plurality of refrigerant flow paths of the first heat exchanger 2. The refrigerant evaporated in the plurality of refrigerant flow paths of the first heat exchanger 2 may be suctioned into the compressor 1 after being combined in evaporator outlet header pipe 6'.

If the air conditioner is a two-way air conditioner that cools and heats, a cooling operation or a heating operation may be performed. When performing the cooling operation, the refrigerant compressed in the compressor 1 may be sequentially passed through the second heat exchanger 4, the expansion mechanism 3, and the first heat exchanger 2, and then, may be suctioned into the compressor 1. The second heat exchanger 4 may be an outdoor heat exchanger to heat-exchange the outdoor air or the coolant with refrigerant, and may be a condenser as well. The first heat exchanger 2 may be configured as an indoor heat exchanger to heat-exchange the indoor air with the refrigerant, and may be an evaporator as well. When performing the heating operation, the refrigerant compressed in the compressor 1 may be sequentially passed through the first heat exchanger 2, the expansion mechanism 3 and the second heat exchanger 4, and then, may be suctioned into the compressor 1. The first heat exchanger 2 may be an indoor heat exchanger to heat-exchange the indoor air with the refrigerant, and may be a condenser as well. The second heat exchanger 4 may be an outdoor heat exchanger to heat-exchange the outdoor air or the coolant with the refrigerant, and may be an evaporator as well.

If the air conditioner is the two-way air conditioner, a plurality of refrigerant flow paths may be provided in the first heat exchanger 2, and the evaporator inlet header distributor 5' may be installed between the expansion mechanism 3 and the first heat exchanger 2. When performing the cooling operation, the evaporator inlet header distributor 5' may distribute the refrigerant expanded in the expansion mechanism 3 to the first heat exchanger 2. When performing the cooling operation, the evaporator inlet header distributor 5' may uniformly distribute the gaseous refrigerant and the liquid refrigerant to the plurality of refrigerant flow paths of the first heat exchanger 2. The evaporator outlet header pipe 6' may be installed between the first heat exchanger 2 and the compressor 1. When performing the cooling operation, the refrigerant expanded in the plurality of refrigerant flow paths of the first heat exchanger 2 may be combined in the evaporator outlet header pipe 6' and then, may be suctioned into the compressor 1. If the air conditioner is the two-way air conditioner, the plurality of refrigerant flow paths may be formed in the second heat exchanger 4, and an evaporator inlet header distributor 5 may be formed between the expansion mechanism 3 and the second heat exchanger 4. When performing the heating operation, the evaporator inlet header distributor 5 may distribute the refrigerant expanded in the expansion mechanism 3 to the second heat exchanger 4, and the evaporator inlet header distributor 5 may uniformly distribute gaseous refrigerant and liquid refrigerant to the plurality of refrigerant flow paths of the second heat exchanger 4. The evaporator outlet header pipe 6 may be installed between the second heat exchanger 4 and the compressor 1. When performing the cooling operation, the refrigerant expanded in the plurality of refrigerant flow paths of the second heat exchanger 4 may be combined in the evaporator outlet header pipe 6, and then, may flow into the compressor 1. In other words, it is possible that in the air conditioner AC, the first heat exchanger 2 and the second heat exchanger 4 each may have a plurality of refrigerant flow paths, the evaporator inlet header distributor 5' may be installed between the expansion mechanism 3 and the first heat exchanger 2, and the evaporator inlet header distributor 5 may be installed between the expansion mechanism 3 and the second heat exchanger 4.

Further, although the first heat exchanger 2 may have the plurality of refrigerant flow paths, and the evaporator inlet header distributor 5' may be installed between the expansion mechanism 3 and the first heat exchanger 2, it is possible that the evaporator inlet header distributor 5 may not be installed between the expansion mechanism 3 and the second heat exchanger 4. In addition, although the second heat exchanger 4 may have the plurality of refrigerant flow paths and the evaporator inlet header distributor 5 may be installed between the expansion mechanism 3 and the second heat exchanger 4, it is possible that the evaporator inlet header distributor 5' may be not installed between the expansion mechanism 3 and the first heat exchanger 2.

Hereinbelow, the air conditioner configured as a heat pump, which is a two-way air conditioner that cools and heats, will be described. With such a configuration, the evaporator inlet header distributor 5' may be installed between the expansion mechanism 3 and the first heat exchanger 2, and the evaporator inlet header distributor 5 may be installed between the expansion mechanism 3 and the second heat exchanger 4. The air conditioner may further include a cooling-heating switching valve 7 that switches the refrigerant flow path when performing the cooling operation and the heating operation.

The compressor 1 may compress the refrigerant evaporated in the evaporator, and the refrigerant evaporated in the evaporator may be suctioned and discharged. A compressor suction flow path 11 may be connected to one side of the compressor 1, the refrigerant being suctioned into the compressor 1 via the compressor suction flow path 11, and a compressor discharge flow path 12 may be connected to the other side of the compressor 1, the refrigerant compressed in the compressor 1 being discharged into the compressor discharge flow path 12. An accumulator 13 may be installed in the compressor suction flow path 11. The accumulator 13 may contain liquid refrigerant and guide gaseous refrigerant to the compressor suction flow path 11. One end of the compressor suction flow path 11 may be connected to the compressor 1, and the other end of the compressor suction flow path 11 may be connected to the cooling-heating switching valve 7. One end of the compressor discharge flow path 12 may be connected to the compressor 1, and the other end of the compressor discharge flow path 12 may be connected to the cooling-heating switching valve 7.

When performing the cooling operation, the first heat exchanger 2 may be an evaporator that evaporates the refrigerant distributed by the evaporator inlet header 5 after being expanded in the expansion mechanism 3, and when performing the heating operation, the first heat exchanger 2 may be a condenser that condenses the refrigerant compressed in the compressor 1. The first heat exchanger 2 may heat-exchange with air blown by indoor fan 8 with the refrigerant and may be installed in an indoor device I together with the indoor fan 8. The first heat exchanger 2 may be configured, for example, as a fin-tube type heat exchanger or a plate type heat exchanger. The first heat exchanger 2 may include a plurality of refrigerant flow paths 21, 22, 23, and 24. When performing the cooling operation, the first heat exchanger 2 may have an overall higher heat-exchanging performance in a case in which a two-phase refrigerant, in which liquid refrigerant and gaseous refrigerant are mixed, is uniformly distributed to the plurality of refrigerant flow paths 21, 22, 23 and 24, and the first heat exchanger 2 may have an overall lower heat-exchanging performance in a case in which liquid refrigerant is concentrated into a portion of the plurality of refrigerant flow paths 21, 22, 23 and 24. In the first heat exchanger 2, one end of each of the plurality of refrigerant flow paths 21, 22, 23 and 24 may be connected to the evaporator inlet header distributor 5' and the other end of each of the plurality of refrigerant flow paths 21, 22, 23 and 24 may be connected to the evaporator outlet header pipe 6'. The evaporator inlet header distributor 5' connected to the first heat exchanger 2 may be connected by an expansion mechanism 3 and an expansion mechanism connecting flow path 51. The evaporator outlet header pipe 6' connected to the first heat exchanger 2 may be connected to the cooling-heating switching valve 7 and a cooling-heating switching valve connecting flow path 61.

The expansion mechanism 3 may expand the refrigerant condensed in the condenser and may include an expansion valve or a capillary tube, such as an EEV or LEV. The expansion mechanism 3 may include one or a plurality of expansion mechanisms. If the first heat exchanger 2 and the second heat exchanger 4 is each connected to an evaporator inlet header distributors 5, 5', the expansion mechanism 3 may be installed between the evaporator inlet header distributor 5' to which the first heat exchanger 2 may be connected and the evaporator inlet header distributor 5 to which the second heat exchanger 4 may be connected.

When performing the cooling operation, the refrigerant condensed in the second heat exchanger 4 may flow according to an order of the evaporator inlet header distributor 5, to which the second heat exchanger 4 may be connected, the expansion mechanism 3, the evaporator inlet header distributor 5', to which the first heat exchanger 2 may be connected, and the first heat exchanger 2. On the other hand, when performing the heating operation, the refrigerant condensed in the first heat exchanger 2 may flow according to the order of the evaporator inlet header distributor 5', to which the first heat exchanger 2 may be connected, the expansion mechanism 3, the evaporator inlet header distributor 5, to which the second heat exchanger 4 may be connected, and the second heat exchanger 4. One expansion mechanism may be installed in any one of the outdoor device O or the indoor device I, and or an indoor expansion mechanism may be installed in the indoor device I, and an outdoor expansion mechanism may be installed in the outdoor device O.

When performing the cooling operation, the second heat exchanger 4 may be a condenser that condenses the refrigerant compressed in the compressor 1, and when performing the heating operation, the second heat exchanger 4 may be an evaporator that evaporates the refrigerant uniformly distributed by the evaporator inlet header 5 after being expanded in the expansion mechanism 3. The second heat exchanger 4 may be configured as an air-cooling heat exchanger that heat-exchanges air blown in by outdoor fan 9 with refrigerant and may be configured as a water-cooling heat exchanger that heat-exchange coolant supplied from a coolant supply source with the refrigerant. If the second heat exchanger 4 is configured as the air-cooling heat exchanger, it may be configured as, for example, a fin-tube type heat exchanger or a plate type heat exchanger. If the second heat exchanger 4 is configured as a water-cooling heat exchanger, it may be configured as a shell-tube type heat exchanger. The second heat exchanger 4 may be installed in the outdoor device O together with the compressor 1 and the outdoor fan 9.

The second heat exchanger 4 may include a plurality of refrigerant flow paths 41, 42, 43 and 44. When performing the heating operation, the second heat exchanger 4 may have an overall higher heat-exchanging performance in a case in which a two-phase refrigerant, in which liquid refrigerant and gaseous refrigerant are mixed, may be uniformly distributed to the plurality of refrigerant flow paths 41, 42, 43 and 44, and the second heat exchanger 4 may have an overall lower heat-exchanging performance in a case in which liquid refrigerant may be concentrated into a portion of the plurality of refrigerant flow paths 41, 42, 43 and 44.

In the second heat exchanger 4, one end of each of the plurality of refrigerant flow paths 41, 42, 43 and 44 may be connected to the evaporator inlet header distributor 5, and the other end of each of the plurality of refrigerant flow paths 41, 42, 43 and 44 may be connected to the evaporator outlet header pipe 6. The evaporator inlet header distributor 5 connected to the second heat exchanger 4 may be connected by the expansion mechanism 3 and an expansion mechanism connecting flow path 52. The evaporator outlet header pipe 6 connected to the second heat exchanger 4 may be connected to the cooling-heating switching valve 7 and a cooling-heating switching valve connecting flow path 62. The evaporator inlet header distributor 5, 5' may uniformly distribute the two-phase refrigerant to the plurality of refrigerant flow paths such that liquid refrigerant may not be concentrated to a portion of the plurality of refrigerant flow paths of the evaporator.

The cooling-heating switching valve 7 may be a 4-way valve. When performing the cooling operation, the cooling-heating switching valve 7 may guide the refrigerant compressed in the compressor 1 to the evaporator outlet header pipe 6 connected to the second heat exchanger 4, and guide the refrigerant flow from the evaporator outlet header pipe 6' connected to the first heat exchanger 2 into the compressor suction flow path 11. When performing the heating operation, the cooling-heating switching valve 7 may guide the refrigerant compressed in the compressor 1 to evaporator outlet header pipe 6' connected to the first heat exchanger 2, and guide the refrigerant flow from the evaporator outlet header pipe 6 connected to the second heat exchanger 4 into the compressor suction flow path 11.

Figure 2:
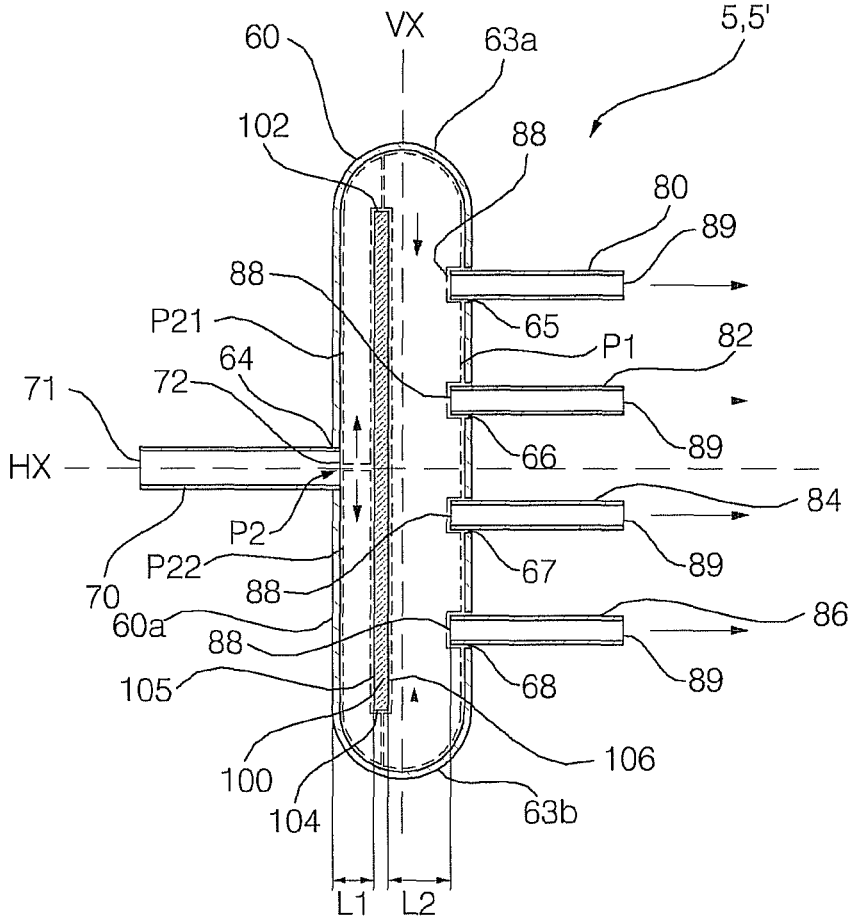
FIG. 2 is a schematic internal cross-sectional diagram of an evaporator inlet header distributor in the air conditioner of FIG. 1.

FIG. 2 is a schematic internal cross-sectional diagram of an evaporator inlet header distributor in the air conditioner of FIG. 1. The evaporator inlet header distributor 5, 5' may include a distributor body 60, a refrigerant inlet pipe 70 to guide refrigerant expanded in the expansion mechanism 3 inside of the distributor body 60, and a plurality of refrigerant outlet pipes 80, 82, 84 and 86 through which the refrigerant of the distributor body 60 may flow into the plurality of refrigerant flow paths of the evaporator. In the evaporator inlet header distributor 5, 5', one refrigerant outlet pipe may be connected to one refrigerant flow path of the evaporator. The evaporator inlet header distributor 5, 5' may include a header flow path P1 through which two-phase refrigerant may be distributed to the plurality of refrigerant outlet pipes 80, 82, 84 and 86, and a refrigerant dispersing flow path P2 that guides a flow of the two-phase refrigerant such that the two-phase refrigerant may be distributed and introduced into an upper portion 63*a* and a lower portion 63*b* of the header flow path P1. In the evaporator inlet header distributor 5, 5', the two-phase refrigerant passing through the refrigerant inlet pipe 70 may be distributed by the refrigerant dispersing flow path P2 to an upper side flow path P21 and a lower side flow path P22 in a substantially vertical or up and down direction, the two-phase refrigerant guided to the upper side flow path P21 may flow into the upper portion 63*a* of the header flow path P1, and the two-phase refrigerant guided to the lower side flow path P22 may flow into the lower portion 63*b* of the header flow path P2. The evaporator inlet header distributor 5, 5' may include a separating plate 90 disposed inside of the distributor body 60. The separating plate 90 may separate the inside of the distributor body 60 into the header flow path P1 connected with the plurality of refrigerant outlet pipes 80, 82, 84 and 86 and the refrigerant dispersing flow path P2 connected with the refrigerant inlet pipe 70.

The distributor body 60 may be positioned in the air conditioner so as to extend in a substantially vertical or up and down direction. A circumferential portion 60*a* of the distributor body 60 may be positioned so as to extend in a substantially vertical or up and down direction, and the upper portion 63*a* and the lower portion 63*b* may be rounded. The upper portion 63*a* may be at a top of the circumferential portion 60*a*, and the lower portion 63*b* may be at a bottom of the circumferential portion 60*a*. The circumferential portion 60*a* may be formed in a hollow cylindrical shape or a hollow square bucket shape. If the upper portion 63*a* is rounded, the two-phase refrigerant of the refrigerant dispersing flow path P2 may easily flow into the upper portion 63*a* of the header flow path P1. If the lower portion 63*b* is rounded, the two-phase refrigerant of the refrigerant dispersing flow path P2 may easily flow into the lower portion 63*b* of the header flow path P1. A refrigerant inlet pipe connecting portion 64 may be formed, and the refrigerant inlet pipe 70 may penetrate or be connected through the refrigerant inlet pipe connecting portion 64. Further, refrigerant outlet pipe penetration holes 65, 66, 67 and 68 may be formed, and the plurality of refrigerant outlet pipes 80, 82, 84 and 86 may penetrate through the refrigerant outlet pipe penetration holes 65, 66, 67 and 68, respectively.

If the evaporator inlet header distributor is the evaporator inlet header distributor 5' connected to the first heat exchanger 2, the distributor body 60 may be installed to be located on a side of the first heat exchanger 2. If the evaporator inlet header distributor is the evaporator inlet header distributor 5 connected to the second heat exchanger 4, the distributor body 60 may be installed to be located on a side of the second heat exchanger 4. The distributor body 60 may be installed to be separated from the evaporator outlet header pipe 6, 6' shown in FIG. 1, and the first heat exchanger 2 and the second heat exchanger 4 may each be disposed between the distributor body 60 and the evaporator outlet header pipe 6, 6' shown in FIG. 1.

If the evaporator inlet header distributor is the evaporator inlet header distributor 5' connected with the first heat exchanger 2, the refrigerant inlet pipe 70 may be connected to the expansion mechanism connecting flow path 51 shown in FIG. 1. If the evaporator inlet header distributor is the evaporator inlet header distributor 5 connected with the second heat exchanger 4, the refrigerant inlet pipe 70 may be connected to the expansion mechanism connecting flow path 52 shown in FIG. 1.

The refrigerant inlet pipe 70 may penetrate the distributor body 60, or be disposed outside of distributor body 60 to be in contact with the distributor body 60. The refrigerant inlet pipe 70 may be installed in the distributor body 60. An inlet stage 71 of the refrigerant inlet pipe 70 may be located outside of the distributor body 60, the refrigerant being introduced in through the inlet stage 71 and turned inside of the distributor body 60 at an outlet stage 72, the refrigerant being discharged to the inside of the distributor body 60 through the outlet stage 72. In the refrigerant inlet pipe 70, a direction for injecting the refrigerant may be determined according to the direction of the outlet stage 72; the outlet stage 72 may be installed to inject the two-phase refrigerant to be turned at the separating plate 90. That is, the outlet stage 72 may be installed to face the separating plate 90.

The refrigerant inlet pipe 70 may be horizontally or obliquely disposed with respect to the distributor body 60. If the refrigerant inlet pipe 70 is obliquely disposed on the distributor body 60 directed upwardly, more of the two-phase refrigerant may flow into the upper side flow path P21 of the refrigerant dispersing flow path P2, and if it is obliquely disposed on the distributor body 60 directed downwardly, more of the two-phase refrigerant may flow into the lower side flow path P22 of the refrigerant dispersing flow path P2. If the refrigerant inlet pipe 70 is installed on a horizontal central axis HX, the two-phase refrigerant may be uniformly distributed to the upper side flow path 21 and the lower side flow path P22. If the refrigerant inlet pipe 70 is installed at a location higher than the horizontal central axis HX, more of the two-phase refrigerant flowing into the upper side flow path 21 may flow into the lower side flow path P22, and if it is installed at a location lower than the horizontal central axis HX, more of the two-phase refrigerant flow into the upper side flow path P21. Thus, the refrigerant inlet pipe 70 may be horizontally disposed on the horizontal central axis HX, upwardly obliquely or downwardly obliquely disposed at a location higher than the horizontal central axis HX, or upwardly obliquely or downwardly obliquely disposed at a location lower than the horizontal central axis HX. Further, the refrigerant inlet pipe 70 may include a single refrigerant inlet pipe connected to a first side of left and right sides of the distributor body 60 based on the vertical center axis VX of the distributor body 60.

The plurality of refrigerant outlet pipes 80, 82, 84 and 86 may penetrate a second side of the left and right sides of the distributor body 60 based on the vertical center axis VX of the distributor body 60. If the evaporator inlet header distributor is the evaporator inlet header distributor 5' connected with the first heat exchanger 2, the refrigerant outlet pipes 80, 82, 84 and 86 may each be connected to the refrigerant flow paths 21, 22, 23 and 24 of the first heat exchanger 2. One refrigerant outlet pipe may be connected each to one refrigerant flow path of the first heat exchanger 2. If the evaporator inlet header distributor is the evaporator inlet header distributor 5 connected with the second heat exchanger 4, the refrigerant outlet pipes 80, 82, 84 and 86 may be each connected to the refrigerant flow paths 41, 42, 43 and 44 of the second heat exchanger 4. One refrigerant outlet pipe may be connected each to one refrigerant flow path of the second heat exchanger 4. The plurality of refrigerant outlet pipes 80, 82, 84 and 86 may penetrate the distributor body 60, or may be separated from the distributor body 60. The plurality of refrigerant outlet pipes 80, 82, 84 and 86 may be inserted into the header flow path P1. An inlet stage 88 of the plurality of refrigerant outlet pipes 80, 82, 84 and 86 may each be located in the header flow path P1, and an outlet stage 89 thereof may each be located outside of the distributor body 60. The inlet stage 88 of the plurality of refrigerant outlet pipes 80, 82, 84 and 86 may be disposed to be opposed to the separating plate 90. If the outlet stage 72 of the refrigerant inlet pipe 70 is disposed to be opposed to a first surface 95 of the separating plate 90, the inlet stage 88 of the plurality of refrigerant outlet pipes 80, 82, 84 and 86 may each be disposed to be opposed to a second (opposite) surface 96 opposite to the first surface 95.

The separating plate 90 may be substantially vertically disposed inside of the distributor body 60. A top 92 of the separating plate 90 may be separated from a top of the distributor body 60, and a bottom 94 thereof may be separated from a bottom of the distributor body 60. An upper end and a lower end of the header flow path P1 and the refrigerant dispersing flow path P2 may each be connected. In the inside of the distributor body 60, the header flow path P1 and the refrigerant dispersing flow path P2 may be separated to the left and right based on the separating plate 90, the upper side flow path P21 of the refrigerant dispersing flow path P2 and the header flow path P1 may be connected in the form of a cross-sectional shape, and the lower side flow path P22 of the refrigerant dispersing flow path P2 and the header flow path P1 may be connected in the form of a 'U' cross-sectional shape. A boundary between the upper side flow path P21 of the refrigerant dispersing flow path P2 and the header flow path P1 may be formed between the top 92 of the separating plate 90 and the top of the distributor body 60, and a boundary between a lower side flow path P22 of the refrigerant dispersing flow path P2 and the header flow path P1 may be formed between the bottom 94 of the separating plate 90 and the bottom of the distributor body 60. The separating plate 90 may be installed such that a distance L1 from the refrigerant inlet pipe 70 to the first surface 95 of the separation plate 90 is shorter than a distance L2 from the plurality of refrigerant outlet pipes 80, 82, 84 and 86 to the second surface 96 of the separation plate.

Hereinafter, operation of an embodiment configured as described above will be described as follows.

First, when performing the heating operation of the air conditioner, the compressor 1 may compress the refrigerant, the first heat exchanger 2 may be a condenser that condenses the refrigerant, the expansion mechanism 3 may expand the refrigerant condensed in the condenser, the evaporator inlet header distributor 5 connected to the second heat exchanger 4 may distribute the refrigerant expanded in the expansion mechanism 3 to the plurality of refrigerant flow paths 41, 42, 43 and 44 of the second heat exchanger 4, the second heat exchanger 4 may be an evaporator that evaporates the refrigerant, and the compressor 1 may compress the refrigerant evaporated in the evaporator. Gaseous refrigerant at a high-temperature and high-pressure may be discharged from the compressor 1, and may then be condensed in the first heat exchanger 2, which may function as a condenser. The refrigerant condensed in the first heat exchanger 2 may be expanded by the expansion mechanism 3, and the two-phase refrigerant of liquid refrigerant and gaseous refrigerant may flow into the evaporator inlet refrigerant distributor 5 connected to the second heat exchanger 4, which may function as an evaporator.

The two-phase refrigerant having flowed into the evaporator inlet refrigerant distributor 5 may flow into the refrigerant dispersing flow path P1 of the distributor body 60 through the refrigerant inlet pipe 70, and may be dispersed into the upper side flow path P21 and the lower side flow path P22 between the distributor body 60 and the separating plate 90 in the substantially vertical or up and down direction. A portion of the two-phase refrigerant may flow into the upper side flow path P21, flow beyond the top 92 of the separating plate 90, and flow into the upper portion of the header flow path P2, and the rest of the two-phase refrigerant may flow into the lower side flow path P22, flow beyond the bottom 94 of the separating plate 90, and flow into the lower portion of the header flow path P2.

If the two-phase refrigerant is configured to flow into only one side of the upper portion of the header flow path P2 or the lower portion of the header flow path P2, in the evaporator inlet header distributor 5, 5', liquid refrigerant may be concentrated to a portion of the plurality of refrigerant outlet pipes 80, 82, 84 and 86 by momentum. The two-phase refrigerant having flowed into the header flow path P2 via the top 92 of the separating plate 90 and the two-phase refrigerant having flowed into the header flow path P2 via the bottom 94 of the separating plate 90 may be mixed in the header flow path P2. The refrigerant having flowed into the header flow path P2 by being dispersed in the up and down directions may be uniformly distributed into the plurality of refrigerant outlet pipes 80, 82, 84 and 86. Thus, liquid refrigerant being concentrated in a portion of the plurality of refrigerant outlet pipes 80, 82, 84 and 86 may be minimized, and the two-phase refrigerant may be uniformly distributed to the plurality of refrigerant flow paths 41, 42, 43 and 44 of the evaporator and evaporated.

The refrigerant evaporated in the plurality of refrigerant flow paths 41, 42, 43 and 44 may be injected into the evaporator outlet header pipe 6 connected to the second heat exchanger 4, and may again be mixed inside of the evaporator outlet header pipe 6. The refrigerant may flow into the compressor 1, and the compressor 1 may compress the refrigerant evaporated in the second heat exchanger 4, which may function as an evaporator.

When performing the cooling operation of the air conditioner, the compressor 1 may compress the refrigerant, the second heat exchanger 4 may be a condenser that condenses the refrigerant, the expansion mechanism 3 may expand the refrigerant condensed in the condenser, the evaporator inlet header distributor 5' connected to the first heat exchanger 2 may distribute the refrigerant expanded in the expansion mechanism 3 to the plurality of refrigerant flow paths 21, 22, 23 and 24 of the first heat exchanger 4, the first heat exchanger 2 may be an evaporator that evaporates the refrigerant, and the compressor 1 may compress the refrigerant evaporated in the evaporator. Gaseous refrigerant at a high-temperature and high-pressure may be discharged from the compressor 1, and may then be condensed in the second heat exchanger 4, which may function as a condenser. The refrigerant condensed in the second heat exchanger 4 may be expanded by the expansion mechanism 3, and the two-phase refrigerant of liquid refrigerant and gaseous refrigerant may flow into the evaporator inlet refrigerant distributor 5' connected to the first heat exchanger 2, which may function as an evaporator.

The two-phase refrigerant having flowed into the evaporator inlet refrigerant distributor 5' connected to the first heat exchanger 2 may be dispersed to the upper side flow path P21 and the lower side flow path P22 in the refrigerant dispersing flow path P1 and then, may flow into the upper portion and lower portion of the header flow path P1, may be again mixed in the header flow path P1, and may be uniformly distributed to the plurality of refrigerant outlet pipes 80, 82, 84 and 86.

The two-phase refrigerant may be uniformly distributed to the plurality of refrigerant flow paths 21, 22, 23 and 24 of the evaporator to be evaporated. The refrigerant evaporated in the plurality of refrigerant flow paths 21, 22, 23 and 24 may be injected into the evaporator outlet header pipe 6' connected to the first heat exchanger 2, and may again be mixed inside of the evaporator outlet header pipe 6'. The refrigerant may flow into the compressor 1, and the compressor 1 may compress the refrigerant evaporated in the first heat exchanger 2, which may function as an evaporator.

Figure 3:
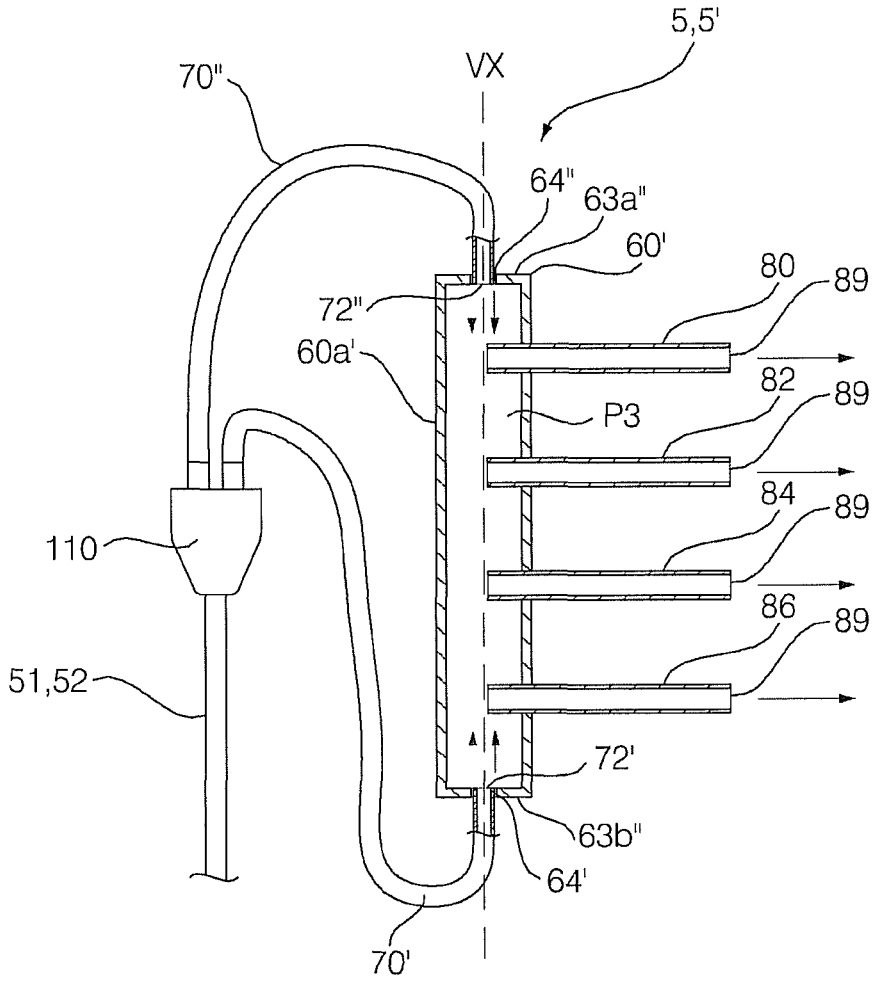
FIG. 3 is a schematic internal cross-sectional diagram of an evaporator inlet header distributor in an air conditioner according to another embodiment.

FIG. 3 is a schematic internal cross-sectional diagram of an evaporator inlet header distributor in an air conditioner according to another embodiment. In the air conditioner according to this embodiment, the evaporator inlet header distributor 5, 5' may include a distributor body 60' formed with a header flow path P3 therein, a lower refrigerant inlet pipe 70' to guide the refrigerant expanded in the expansion mechanism 3 to a lower portion of the header flow path P3, an upper refrigerant inlet pipe 70" to guide the refrigerant expanded in the expansion mechanism 3 to an upper portion of the header flow path P3, and a plurality of refrigerant outlet pipes 80, 82, 84 and 86 through which the refrigerant of the distributor body 60' may be discharged to the refrigerant flow path of the evaporator. An outlet stage 72' of the lower refrigerant inlet pipe 70' and an outlet stage 72" of the upper refrigerant inlet pipe 70" may be disposed to face each other in the substantially vertical or up and down direction. The configuration and operation of the air conditioner of this embodiment is similar to the previous embodiment, except for the evaporator inlet header distributor 5, 5', and thus, repetitive description thereof has been omitted.

The distributor body 60' may be formed with the inner flow path P3, which corresponds to the header flow path P1 of the previous embodiment. The distributor body 60' may be formed to extend in a substantially vertical direction in the air conditioner, similar to the distributor body 60 of the previous embodiment. A circumference portion 60*a*' of the distributor body 60' may extend in a substantially vertical direction, such that an upper portion 63*a*' may be formed at a top of the circumference portion 60*a*', and a lower portion 63*b*' may be formed at a bottom of the circumference portion 60*a*'. In the distributor body 60', a lower refrigerant inlet pipe connecting portion 64' may penetrate or connect to the lower refrigerant inlet pipe 70', and the upper refrigerant inlet pipe connecting portion 64" may penetrate or connect to the upper refrigerant inlet pipe 70". Alternatively, the lower refrigerant inlet pipe connecting portion 64' may be formed on the lower portion 63*b*' of the distributor body 60, and the upper refrigerant inlet pipe connecting portion 64" may be on the upper portion 63*a*' of the distributor body 60. A plurality of refrigerant outlet pipe penetration holes 65, 66, 67 and 68 may be formed through which the plurality of refrigerant outlet pipes 80, 82, 84 and 86 may penetrate.

The lower refrigerant inlet pipe 70' and the upper refrigerant inlet pipe 70" may be branched from the expansion mechanism connecting flow path 51, 52. The lower refrigerant inlet pipe 70' and the upper refrigerant inlet pipe 70" may be directly connected to the expansion mechanism connecting flow path 51, 52, or may be connected to the expansion mechanism connecting flow path 51, 52 through a separate refrigerant distributor 98.

The outlet stage 72' of the lower refrigerant inlet pipe 70' and the outlet stage 72" of the upper refrigerant inlet pipe 70" may be located on a vertical center axis VX of the distributor body 60'. The lower refrigerant inlet pipe 70' may be connected to the lower portion 63*b*' of the distributor body 60, and the upper refrigerant inlet pipe 70" may be connected to the upper portion 63*a*' of the distributor body 60. The lower refrigerant inlet pipe 70' and the upper refrigerant inlet pipe 70" may correspond to the refrigerant dispersing flow path P2 of the previous embodiment. The lower refrigerant inlet pipe 70' may correspond to the lower side flow path P22 of the previous embodiment, and the upper refrigerant inlet pipe 70" may correspond to the upper side flow path P21 of the previous embodiment. If the lower refrigerant inlet pipe 70' and the upper refrigerant inlet pipe 70" are installed side by side close to each other on the circumference portion 60*a*' of the distributor body 60, the two-phase refrigerant may be concentrated in refrigerant outlet pipes 82 and 84 roughly located at a middle portion of the plurality of refrigerant outlet pipes 80, 82, 84 and 86. On the other hand, if the outlet stage 72' of the lower refrigerant inlet pipe 70' and the outlet stage 72" of the upper refrigerant inlet pipe 70" are disposed to face each other in the substantially vertical or up and down direction, the two-phase refrigerant upwardly flowing from the outlet stage 72' of the lower refrigerant inlet pipe 70' to the distributor body 60 and the two-phase refrigerant downwardly flowing from the outlet stage 72" of the upper refrigerant inlet pipe 70" to the distributor body 60 may be mixed in the distributor body 60 and may be uniformly distributed into the plurality of refrigerant outlet pipes 80, 82, 84 and 86, and concentration of liquid refrigerant in a portion of the plurality of refrigerant outlet pipes 80, 82, 84 and 86 may be minimized.

Figure 4:
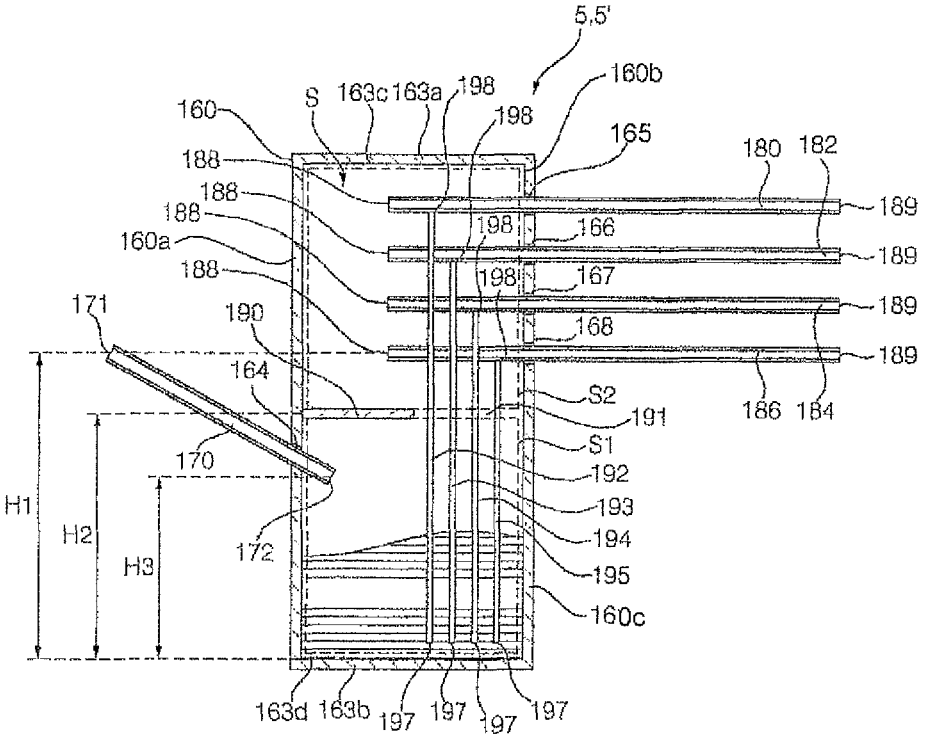
FIG. 4 is a schematic internal cross-sectional diagram of an evaporator inlet header distributor in an air conditioner according to another embodiment.

FIG. 4 is a schematic internal cross-sectional diagram of an evaporator inlet header distributor in an air conditioner according to another embodiment.

The evaporator inlet header distributor 5, 5' of this embodiment may separate the two-phase refrigerant expanded by the expansion mechanism 3 into liquid refrigerant and gaseous refrigerant in the inside thereof, and may uniformly distribute the separated gaseous refrigerant and the liquid refrigerant to a plurality of refrigerant discharge or outlet pipes through a plurality of separate liquid refrigerant suction lines. The evaporator inlet header distributor 5, 5' may be a gaseous-liquid separator two-way header distributor. Otherwise, the configuration and operations of this embodiment are similar to the previous embodiment, except for the evaporator inlet header distributor 5, 5', and thus, repetitive description thereof has been omitted.

The evaporator inlet header distributor 5, 5' may include a distributor body 160 in which a space S may be formed inside thereof, a refrigerant inlet pipe 170 to guide the refrigerant expanded in the expansion mechanism 3 to a lower portion of the space S, a plurality of refrigerant outlet pipes 180, 182, 184 and 186 through which the refrigerant in the space S may flow out of the distribution body, and a plurality of liquid refrigerant suction lines 192, 193, 194 and 195 to guide liquid refrigerant in a lower portion of the space S to the plurality of refrigerant outlet pipes 180, 182, 184 and 186. A partition wall 190 may be provided in the space S to separate the liquid refrigerant and the gaseous refrigerant.

The distributor body 160 may include a circumferential portion 160*a*, an upper plate 163*a* formed at a top of the circumferential portion 160*a*, and a lower plate 163*b* formed at a bottom of the circumferential portion 160*a*. The distributor body 160 may extend in a substantially vertical direction in the air conditioner. The circumferential portion 160*a* may extend in a substantially vertical direction. The circumferential portion 160*a* may be in the form of a hollow cylindrical shape or a hollow square bucket shape. The distributor body 160 may be formed with a refrigerant inlet pipe penetration hole 164 through which the refrigerant inlet pipe 170 may penetrate, and refrigerant outlet pipe penetration holes 165, 166, 167 and 168 through which the plurality of refrigerant outlet pipes 180, 182, 184 and 186 may penetrate.

If the evaporator inlet header distributor 5' is the evaporator inlet header distributor connected to the first heat exchanger 2, the distributor body 160 may be formed to be located on a side of the first heat exchanger 2. If the evaporator inlet header distributor is the evaporator inlet header distributor 5 connected to the second heat exchanger 4, the distributor body 160 may be installed to be located on a side of the second heat exchanger 4. The distributor body 160 may be installed to be separated from the evaporator outlet header pipe 6, 6' shown in FIG. 1, and the first heat exchanger 2 and the second heat exchanger 4 may each be disposed between the distributor body 160 and the evaporator outlet header pipe 6, 6' shown in FIG. 1.

If the evaporator inlet header distributor is the evaporator inlet header distributor 5' connected to the first heat exchanger 2, the refrigerant inlet pipe 170 may be connected to the expansion mechanism connecting flow path 151 shown in FIG. 1. If the evaporator inlet header distributor is the evaporator inlet header distributor 5 connected to the second heat exchanger 4, the refrigerant inlet pipe 170 may be connected to the expansion mechanism connecting flow path 52 shown in FIG. 1. The refrigerant inlet pipe 170 may be disposed to penetrate the distributor body 160. The refrigerant inlet pipe 170 may be installed on the distributor body 160. An inlet stage 171 of the refrigerant inlet pipe 170 through which the refrigerant may flow in may be located outside of the distributor body 160, and an outlet stage 172 may be located in the space S of the distributor body 160 from which the refrigerant may flow out. A refrigerant injecting direction of the refrigerant inlet pipe 170 may be determined in accordance with a direction of the outlet stage 172, and the outlet stage 172 may face the lower portion of the space S.

The refrigerant inlet pipe 170 may be obliquely disposed on the circumferential portion 160*a* of the distributor body 160. The refrigerant inlet pipe 170 may be installed such that the outlet stage 172 extends downward toward a lower portion 160*c* of an inner surface of the circumferential portion 160*a*, or may extend downward toward an upper surface 163*d* of the lower plate 163*b* of the distributor body 160. In this case, the gaseous refrigerant and the liquid refrigerant guided to the refrigerant inlet pipe 170 may flow into the lower portion, not the upper portion of the space S. The refrigerant inlet pipe 170 may be installed such that the outlet stage 172 extends upwardly toward an upper portion of the inner surface of the circumferential portion 160*a* of the distributor body 160, or may extend upwardly toward a lower surface 163*c* of the upper plate 163*a* of the distributor body 160. In this case, the gaseous refrigerant and the liquid refrigerant guided to the refrigerant inlet pipe 170 may flow into the upper portion of the space S. The refrigerant inlet pipe 170 may be installed such that the liquid refrigerant does not directly flow into an inlet stage 188 of the plurality of refrigerant outlet pipes 180, 182, 184 and 186. Rather, the outlet stage 172 may be oriented toward the lower portion 160*c* of the inner surface of the circumferential portion 160*a* of the distributor body 160, or may be oriented toward the upper surface 163*d* of the lower plate 163*b* of the distributor body 160.

If the evaporator inlet header distributor is the evaporator inlet header distributor 5' connected to the first heat exchanger 2, the plurality of refrigerant outlet pipes 180, 182, 184 and 186 may each be connected to the plurality of refrigerant flow paths 21, 22, 23 and 24 of the first heat exchanger 2. The evaporator inlet header distributor 5' may be each connected such that the plurality of refrigerant outlet pipes may be connected to the refrigerant flow path of the first heat exchanger 2 one by one.

If the evaporator inlet header distributor is the evaporator inlet header distributor 5 connected to the second heat exchanger 4, the plurality of refrigerant outlet pipes 180, 182, 184 and 186 may each be connected to the plurality of refrigerant flow paths 41, 42, 43 and 44 of the second heat exchanger 4. In the evaporator inlet header distributor 5, the plurality of refrigerant outlet pipes may each be connected to the refrigerant flow path of the second heat exchanger 4 one by one.

The plurality of refrigerant outlet pipes 180, 182, 184 and 186 may penetrate the distributor body 160. The plurality of refrigerant outlet pipes 180, 182, 184 and 186 may be separated from the distributor body 160. The plurality of refrigerant outlet pipes 180, 182, 184 and 186 may be inserted into the upper portion of the space S. The inlet stage 188 of the plurality of refrigerant outlet pipes 180, 182, 184 and 186 may each be located in the space S, and an outlet stage 189 may be located outside of the distributor body 160.

The inlet stage 188 of the refrigerant outlet pipe 186 located at a lowest side may have a height from the lower plate 163*b* of the distributor body 160 higher than the partition wall 190. In other words, the height H1 between the inlet stage 188 of the refrigerant outlet pipe 186 located on the lowest side of the plurality of refrigerant outlet pipes 180, 182, 184 and 186 and the lower plate 163*b* of the distributor body 160 may be higher than the height H2 between the partition wall 190 and the lower plate 163*b* of the distributor body 160. As the evaporator inlet header distributor 5 may function as a gaseous-liquid separator, only the gaseous refrigerant in the inlet stage 188 or mainly the gaseous refrigerant may be introduced into the plurality of refrigerant outlet pipes 180, 182, 184 and 186, and the inlet stage 188 may be a gaseous refrigerant inlet portion.

The plurality of liquid refrigerant suction lines 192, 193, 194 and 195 may guide the liquid refrigerant accumulated in the lower portion of the space S of the distributor body 160 to the plurality of refrigerant outlet pipes 180, 182, 184 and 186. The plurality of liquid refrigerant suction lines 192, 193, 194 and 195 may be connected to the plurality of refrigerant outlet pipes 180, 182, 184, and 186 at a location separated from the inlet stage 188 of the plurality of refrigerant outlet pipes 180, 182, 184 and 186. A bottom 197 of the plurality of liquid refrigerant suction lines 192, 193, 194 and 195 may be separated from the lower plate 163*b* of the distributor body 160. A top 198 of the plurality of liquid refrigerant suction lines 192, 193, 194 and 195 may be connected to a portion of the plurality of refrigerant outlet pipes 180, 182, 184 and 186 located in the distributor body 160. The plurality of liquid refrigerant suction lines 192, 193, 194 and 195 may be connected to the refrigerant outlet pipe one by one, and may be connected to one refrigerant outlet pipe. If the plurality of refrigerant outlet pipes 180, 182, 184 and 186 have different heights, the plurality of liquid refrigerant suction lines 192, 193, 194 and 195 may have different heights.

The partition wall 190 may be a gaseous-liquid separation plate by which the refrigerant introduced into the space S through the refrigerant inlet pipe 170 may be separated into gaseous refrigerant and liquid refrigerant. The liquid refrigerant that impacts on the partition wall 190 introduced into the space S through the refrigerant inlet pipe 170 may be blocked by the partition wall 190, and thus, may not flow to the upper side of the space S and may fall into the lower portion of the space S by gravity. The gaseous refrigerant that impacts on the partition wall 190 in the refrigerant introduced into the space S through the refrigerant inlet pipe 170 may pass between the partition wall 190 and the distributor body 160, or may flow into the upper portion of the space S by passing the partition wall 190.

The partition wall 190 may be plate-shaped. The partition wall 190 may divide the space S into a lower side space S1 in which both the liquid refrigerant and the gaseous refrigerant are located on the inner side of the circumferential portion 160*a* of the distributor body 160 and an upper side space S2 in which the gaseous refrigerant is passed between the partition wall 190 and the distributor body 160, or the gaseous refrigerant that passed the partition wall 190 flows.

The partition wall 190 may have a height from the lower plate 163*b* of the distributor body 160 higher than the outlet stage 172 of the refrigerant inlet pipe 170. In other words, the height H2 between the partition wall 190 and the lower plate 163*b* of the distributor body 160 may be higher than the height H3 between the outlet stage 172 of the refrigerant inlet pipe 170 and the lower plate 163*b* of the distributor body 160.

The partition wall 190 may be disposed to have a gap 191 and an inner peripheral surface of the distributor body 160. The partition wall 190 may be in the form of a plate formed smaller than a cross-sectional area of the circumferential portion 160*a* in a horizontal direction. The plurality of liquid refrigerant suction lines 192, 193, 194 and 195 may penetrate the gap 191. The gaseous refrigerant in the refrigerant introduced into the space S through the refrigerant inlet pipe 170 may flow into the upper portion of the space S by passing through the gap 191.

Alternatively, an overall outer circumference of the partition wall 190 may be close to an inner peripheral surface of the distributor body 160, and a hole passing the gaseous refrigerant or a hole(s) that the suction line(s) penetrate may be separately formed, or a hole through which the gaseous refrigerant and the liquid refrigerant suction lines penetrate together may be formed.

Figure 5:
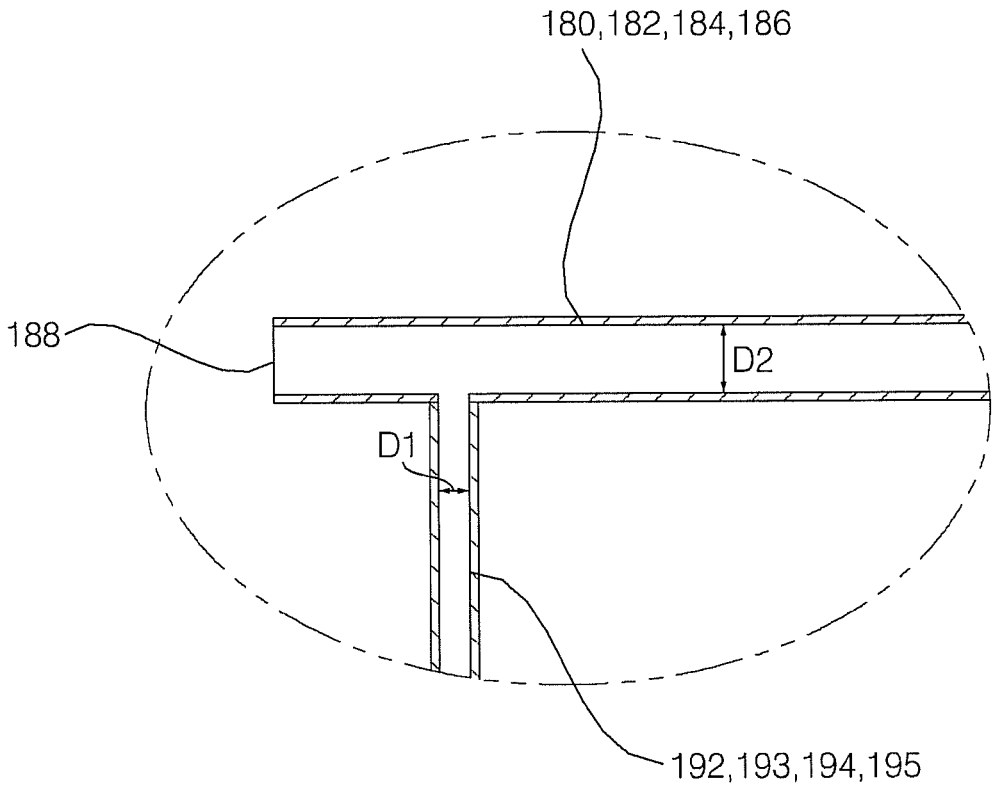
FIG. 5 is a schematic enlarged cross-sectional diagram of a refrigerant outlet pipe and a liquid refrigerant suction line in the evaporator inlet header distributor of FIG. 4.

FIG. 5 is a schematic enlarged cross-sectional diagram of a refrigerant outlet pipe and a liquid refrigerant suction line in the evaporator inlet header distributor of FIG. 4. The plurality of liquid refrigerant suction lines 192, 193, 194 and 195 may each have an internal cross-sectional area smaller than the plurality of refrigerant outlet pipes 180, 182, 184 and 186. In other words, the internal cross-sectional area D1 of the liquid refrigerant suction lines 192, 193, 194 and 195 may be smaller than the internal cross-sectional area D2 of the refrigerant outlet pipes 180, 182, 184 and 186.

Hereinafter, operation of an evaporator inlet header distributor configured as described above will be explained as follows.

First, when performing the heating operation of the air conditioner, gaseous refrigerant at high-temperature and high-pressure may be discharged from the compressor 1 and may be condensed in the first heat exchanger 2, which may function as a condenser. The refrigerant condensed in the first heat exchanger 2 may be expanded by expansion mechanism 3, and the refrigerant of mixed liquid refrigerant and gaseous refrigerant may flow into the evaporator inlet header distributor 5 connected to the second heat exchanger 4, which may function as an evaporator. The refrigerant having flowed into the evaporator inlet header distributor 5 may be introduced into distributor body 160 through the refrigerant inlet pipe 170, and may be introduced into the lower portion of the space S of the distributor body 160. The liquid refrigerant in the refrigerant introduced into the lower portion of the space S of the distributor body 160 may collect in the lower portion of the space S, without being elevated to the upper portion of the space S, and after the gaseous refrigerant flows into the upper portion of the space S, it may be suctioned into each inlet stage 188 of the plurality of refrigerant outlet pipes 180, 182, 184 and 186 to be distributed to the plurality of refrigerant outlet pipes 180, 182, 184 and 186. The liquid refrigerant may collected in the lower portion of the space S of the distributor body 60, and be dispersed and introduced into the plurality of liquid refrigerant suction lines 192, 193, 194 and 195. The liquid refrigerant introduced into the plurality of liquid refrigerant suction lines 192, 193, 194 and 195 may be elevated along the plurality of liquid refrigerant suction lines 192, 193, 194 and 195 to reach the plurality of refrigerant outlet pipes 180, 182, 184 and 186 and may be mixed with the gaseous refrigerant suctioned through the inlet stage 188 of the plurality of refrigerant outlet pipes 180, 182, 184 and 186. After being combined, the mixed gaseous refrigerant and liquid refrigerant may flow, and the two-phase refrigerant may be uniformly distributed to the plurality of refrigerant flow paths 41, 42, 43 and 44 of the evaporator and evaporated. The refrigerant evaporated in each of the plurality of refrigerant flow paths 41, 42, 43 and 44 may be introduced into the evaporator outlet header pipe 6 connected to the second heat exchanger 4, and may be again mixed in the evaporator outlet header pipe 6. The refrigerant may flow into the compressor 1, and the compressor 1 may compress the refrigerant evaporated in the second heat exchanger 4, which may function as an evaporator.

When performing the cooling operation of the air conditioner, the gaseous refrigerant at high-temperature and high-pressure may be discharged from the compressor 1 and may be condensed in the second heat exchanger 4, which may function as a condenser. The refrigerant condensed in the second heat exchanger 4 may be expanded by the expansion mechanism 3, and the mixed liquid refrigerant and gaseous refrigerant may flow into the evaporator inlet header distributor 5' connected to the first heat exchanger 2, which may function as an evaporator. The evaporator inlet header distributor 5' connected to the first heat exchanger 2, similar to the evaporator inlet header distributor 5 connected to the second heat exchanger 4, may separate the gaseous refrigerant and liquid refrigerant and then, may disperse the gaseous refrigerant to each inlet stage 188 of the plurality of refrigerant outlet pipes 180, 182, 184 and 186, and may disperse the liquid refrigerant to the plurality of liquid refrigerant suction lines 192, 193, 194 and 195. The gaseous refrigerant suctioned into the inlet stage 188 of the plurality of refrigerant outlet pipes 180, 182, 184 and 186 and the liquid refrigerant suctioned into the plurality of liquid refrigerant suction lines 192, 193, 194 and 195 may be mixed at a combined point of the plurality of refrigerant outlet pipes 180, 182, 184 and 186 and the plurality of liquid refrigerant suction lines 192, 193, 194 and 195, and the mixed two-phase refrigerant may be uniformly distributed to the plurality of refrigerant flow paths 21, 22, 23 and 24 of the evaporator and evaporated. The refrigerant evaporated in each of the plurality of refrigerant flow paths 21, 22, 23 and 24 may be introduced into the evaporator outlet header pipe 6' connected to the first heat exchanger 2 and may be again mixed in the evaporator outlet header pipe 6'. The refrigerant may flow into the compressor 1, and the compressor 1 may compress the refrigerant evaporated in the first heat exchanger 2, which may function as an evaporator.

Figure 6:
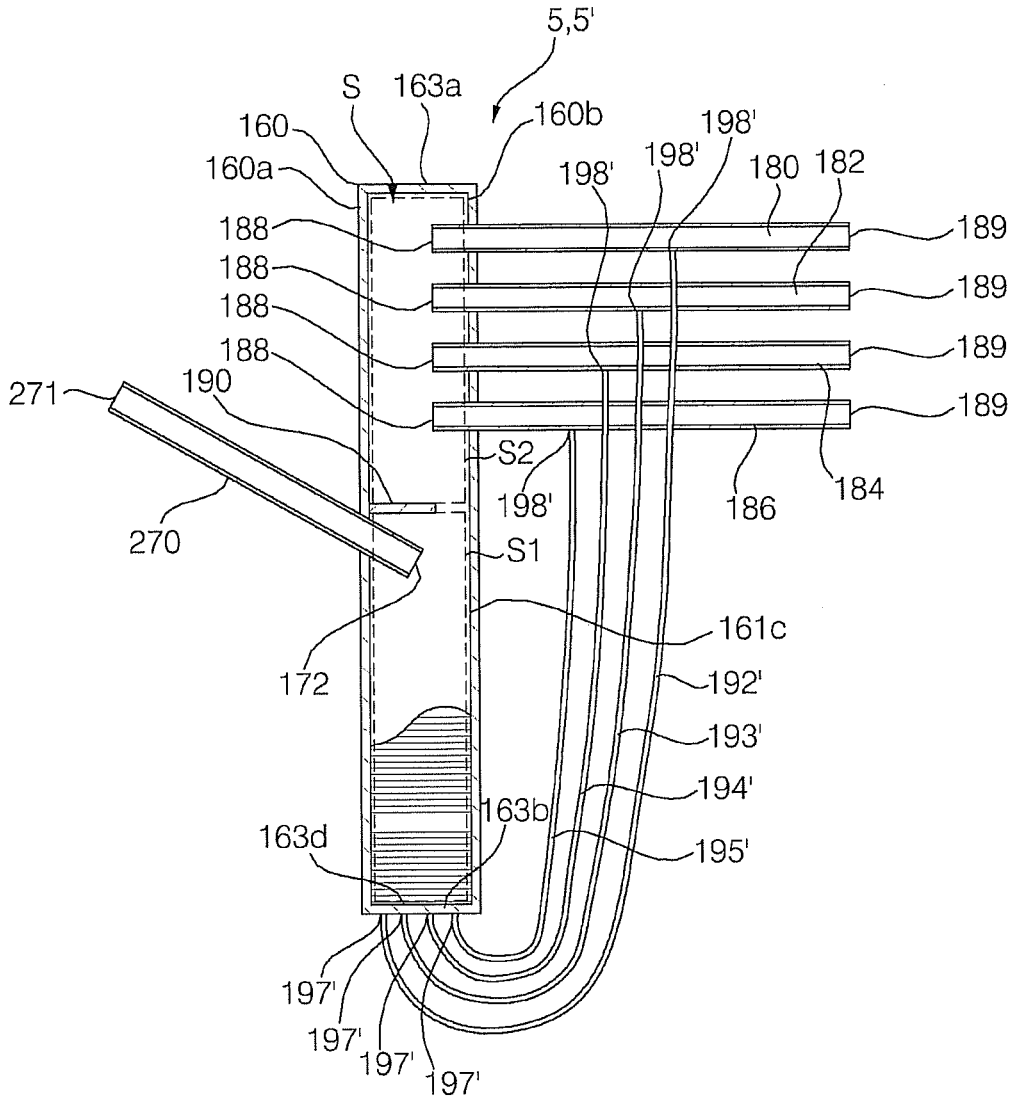
FIG. 6 is a schematic internal cross-sectional diagram of an evaporator inlet header distributor in an air conditioner according to another embodiment.

FIG. 6 is a schematic internal cross-sectional diagram of an evaporator inlet header distributor in an air conditioner according to another embodiment. In the air conditioner according to this embodiment, a plurality of liquid refrigerant suction lines 192', 193', 194' and 195' may be connected with a plurality of refrigerant outlet pipes 180, 182, 184 and 186 outside of the distributor body 160. As the configuration and operation of the air conditioner of this embodiment is similar to the previous embodiment, except for the a plurality of refrigerant outlet pipes 180, 182, 184 and 186 and the plurality of liquid refrigerant suction lines 192', 193', 194' and 195', and repetitive description has been omitted.

One end 197' of each of the plurality of liquid refrigerant suction lines 192', 193', 194' and 195' may be connected to lower plate 163*b* of the distributor body 160 or a lower portion of circumferential portion 160*a* of the distributor body 160. Another end 198' of the each of the plurality of liquid refrigerant suction lines 192', 193', 194' and 195 may be connected to a portion of the plurality of refrigerant outlet pipes 180, 182, 184 and 186 located outside of the distributor body 160.

In the air conditioner according to this embodiment, the two-phase refrigerant having flowed into the inside of the distributor body 160 through refrigerant inlet pipe 170 after being expanded in expansion mechanism 3 may be separated into gaseous refrigerant and the liquid refrigerant in the distributor body 160, and liquid refrigerant and the separated gaseous refrigerant may be dispersed and flow into the plurality of refrigerant outlet pipes 180, 182, 184 and 186 through each inlet stage 188 of the plurality of refrigerant outlet pipes 180, 182, 184 and 186, as in the previous embodiment. The gaseous refrigerant and the separated liquid refrigerant may be collected in the lower portion of the space S of the distributor body 160, and may be dispersed and flow into the plurality of liquid refrigerant suction lines 192', 193', 194' and 195'. The liquid refrigerant having flowed into the plurality of liquid refrigerant suction lines 192', 193', 194' and 195' may be introduced into the plurality of refrigerant outlet pipes 180, 182, 184 and 186 from outside of the distributor body 160, and may be mixed with the gaseous refrigerant suctioned in the plurality of refrigerant outlet pipes 180, 182, 184 and 186. The mixed two-phase refrigerant may be uniformly dispersed into the plurality of refrigerant flow paths of the evaporator, and then, may be compressed in the compressor 1, as in the previous embodiment.

Figure 7:
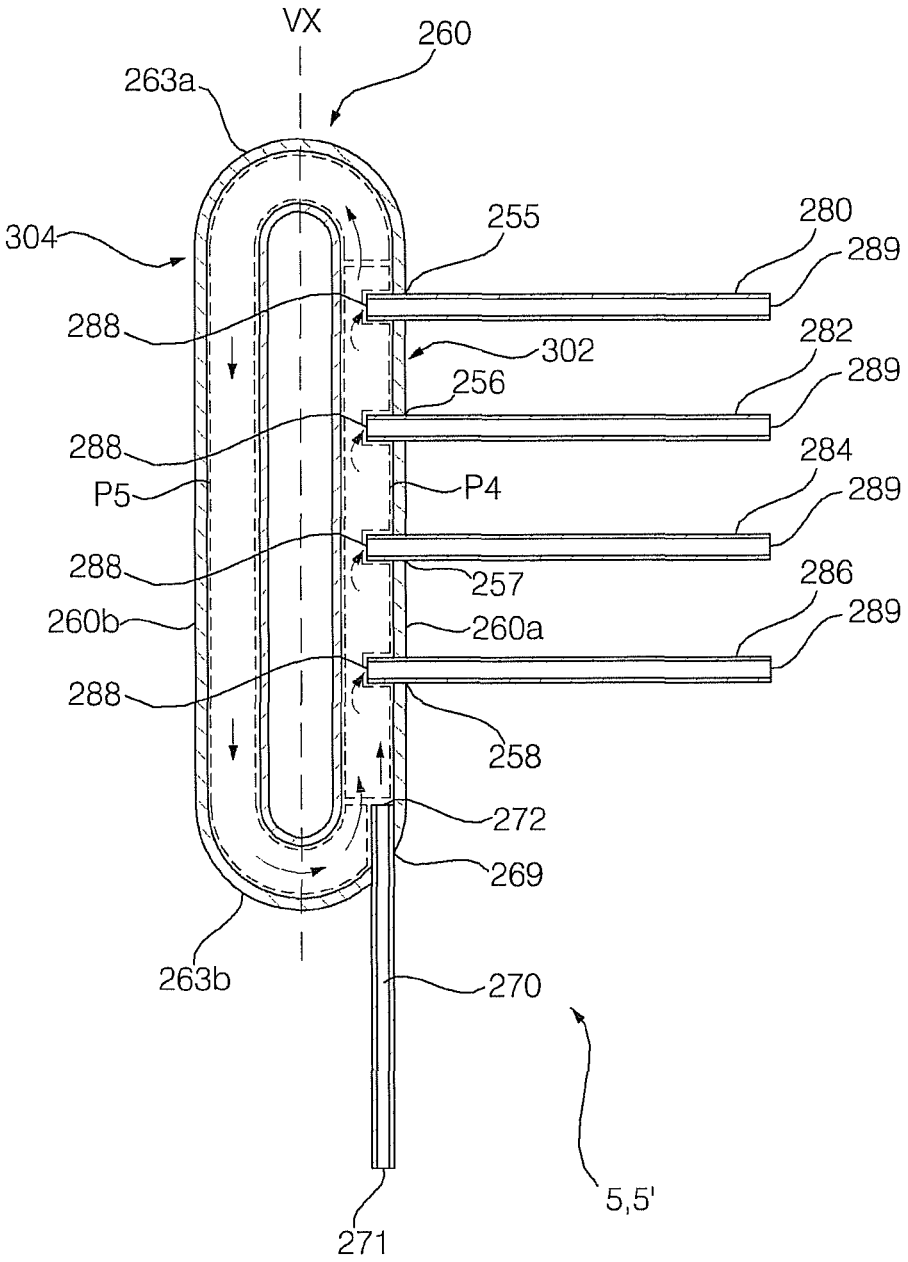
FIG. 7 is a schematic internal cross-sectional diagram of an evaporator inlet header distributor in an air conditioner according to another embodiment.

FIG. 7 is a schematic internal cross-sectional diagram of an evaporator inlet header distributor in an air conditioner according to another embodiment. The evaporator inlet header distributor 5, 5' according to this embodiment may include a distributor body 260, a refrigerant inlet pipe 270, and a plurality of refrigerant outlet pipes 280, 282, 284 and 286. The refrigerant may be introduced into the distributor body 260 through the refrigerant inlet pipe 270, and then, may be distributed into the plurality of refrigerant outlet pipes 280, 282, 284 and 286 in the distributor body 260. The refrigerant distributed into the plurality of refrigerant outlet pipes 280, 282, 284 and 286 may be guided to the plurality of refrigerant flow paths of the evaporator.

The distributor body 260 may include a header flow path 302 to which the plurality of refrigerant outlet pipes 280, 282, 284 and 286 may be connected, and a return flow path 304 connected to an upper side and the lower side of the header flow path 302 to connect the upper side and the lower side of the header flow path 302. In the distributor body 260, an area to which the plurality of refrigerant outlet pipes 280, 282, 284, and 286 is connected, inner flow path P4, may be the header flow path 302 and areas other than that area, inner flow path P5, may be the return flow path 304.

The evaporator inlet header distributor according to this embodiment and the following embodiments solve problems associated with the prior art. That is, with prior art structures, due to the difference in inertia between the refrigerant in a gaseous state and the refrigerant in a liquid state, the liquid refrigerant tended to gather at a top of the distributor, so that a greater amount of liquid refrigerant was introduced to the upper refrigerant outlet pipes. With the evaporator inlet header distributor according to this embodiment, a central longitudinal axis of which is substantially vertically oriented, return path 304 may be provided, which may direct the gathered liquid refrigerant back into header flow path 304 utilizing gravity. Further, a low pressure area may be created adjacent to a high pressure area created by refrigerant inlet pipe 270, which allows the liquid refrigerant in the return flow path 302 to easily flow into the header flow path 302 and join the refrigerant being introduced via the refrigerant inlet pipe 270. This results in a more even distribution of two-phase refrigerant to the plurality of refrigerant outlet pipes 280, 282, 284, and 286.

The header flow path 302 may extend in a substantially vertical direction. In the header flow path 302, the inner flow path P4 may extend in a substantially vertical direction. Refrigerant outlet pipe penetration holes 255, 256, 257 and 258, through which the refrigerant outlet pipes may penetrate, may be formed on the header flow path 302.

The return flow path 304 may return two-phase refrigerant, being supplied from the refrigerant inlet pipe 270 to the header flow path 302, to the refrigerant inlet pipe 270 side. If the return flow path 304 does not exist, the liquid refrigerant may be concentrated at a side opposed to of the refrigerant inlet pipe 270 in the header flow path 302, and the liquid refrigerant may be excessively introduced into the refrigerant outlet pipe 280 positioned a longer distance from the refrigerant inlet pipe 270 of the plurality of refrigerant outlet pipes 280, 282, 284 and 286. On the other hand, if the return flow path 304 does exist, a portion of liquid refrigerant located on the side opposed to the refrigerant inlet pipe 270 in the header flow path 302 may again flow into the refrigerant inlet pipe 270 along the return flow path portion 304, and concentration of liquid refrigerant into the side opposed to the refrigerant inlet pipe 270 of the header flow path 302 may be minimized. If the refrigerant inlet pipe 270 supplies the two-phase refrigerant from the lower side of the header flow path 302, the return flow path 304 may guide the refrigerant having flowed into the upper side of the header flow path 302 to the lower side of the header flow path 302. If the refrigerant inlet pipe 270 supplies the two-phase refrigerant from the upper side of the header flow path 302 to the header flow path 302, the return flow path 304 may guide the refrigerant having flowed into the lower side of the header flow path 302 to the upper side of the header flow path 302. The return flow path 304 may be located outside of the header flow path 302, may be connected to a top of the header flow path 302, or may be connected to a bottom of the header flow path 302.

The distributor body 260 may include a first pipe 260*a* into which the plurality of refrigerant outlet pipes 280, 282, 284 and 286 may penetrate, a second pipe 260*b* separate from the first pipe 260*a*, an upper connecting pipe 263*a* to connect an upper portion of the first pipe 260*a* and an upper portion of the second pipe 260*b*, and a lower connecting pipe 263*b* to connect a lower portion of the first pipe 260*a* and a lower portion of the second pipe 260*b*. The first pipe 260*a* may be in the form of a straight tube extending in a substantially vertical direction. The second pipe 260*a* may be in the form of a straight tube or a curved tube shape. The second pipe 260*b* may be separate from the first pipe 260*a*.

The upper connecting pipe 263*a* may be in the form of a curved tube shape. The upper connecting pipe 263*a* may have a flow path having a '∩' shape formed inside thereof.

The lower connecting pipe 263*b* may be in the form of a curved tube shape. The lower connecting pipe 263*b* may have a flow path having a '∪' shape formed inside thereof.

In the distributor body 260, the first pipe 260*a* may comprise the header flow path 302, and the second pipe 260*a*, the upper connecting pipe 263*a*, and the lower connecting pipe 263*b* may comprise the return flow path portion 304. Alternatively, the upper connecting pipe 263*a*, the first pipe 260*a*, and the lower connecting pipe 263*b* may be the header flow path 302, and the second pipe 260*b* may be the return flow path 304.

Based on a vertical center axis VX, a portion of the upper connecting pipe 263, a portion of the first pipe 260*a*, and a portion of the lower connecting pipe 263*b* may be considered the header flow path portion 302, and the rest of the upper connecting pipe 263*a*, the rest of the second pipe 260*b*, and lower connecting pipe 263*b* may be considered the return flow path 304. If the refrigerant outlet pipes are located on a left side of the header flow path 302, the return flow path 304 may be located on an upper side, a right side, and a lower side of the header flow path 302. If the refrigerant outlet pipes are located on the right side of the header flow path 302, the return flow path 304 may be located on the upper side, the left side, and the lower side of the header flow path 302.

The refrigerant inlet pipe penetration hole 269 in the distributor body 260, through which the refrigerant inlet pipe 270 may penetrate, may be formed on any one of the header flow path 302 and the return flow path 304. Further, the refrigerant inlet pipe penetration hole 269 may be formed on a lower side of the header flow path 302.

If the evaporator inlet header distributor is the evaporator inlet header distributor 5' connected to the first heat exchanger 2, the refrigerant inlet pipe 270 may be connected to the expansion mechanism connecting flow path 51 shown in FIG. 1. If the evaporator inlet header distributor is the evaporator inlet header distributor 5 connected to the second heat exchanger 4, the refrigerant inlet pipe 270 may be connected to the expansion mechanism connecting flow path 52 shown in FIG. 1. The refrigerant inlet pipe 270 may penetrate the distributor body 260, or may be disposed to be connected to the distributor body 260. The refrigerant inlet pipe 270 may be installed in the distributor body 260. An inlet stage 271 of the refrigerant inlet pipe 270 may be located outside of the distributor body 260, the refrigerant being input through the inlet stage 271, and an outlet stage 272 may be located inside of the distributor body 260. In the refrigerant inlet pipe 270, a refrigerant injecting direction may correspond to a direction of the outlet stage 272. The refrigerant inlet pipe 270 may guide the refrigerant expanded in the expansion mechanism 3 to any one of the header flow path 302 or the return flow path 304. The outlet stage 272 may face an upper portion or a lower portion of the header flow path 302. The refrigerant inlet pipe 270 may be installed in a lower portion of the distributor body 260. The outlet stage 272 may be formed at a top of the refrigerant inlet pipe 270, and may face the header flow path 302. The refrigerant inlet pipe 270 may extend in the same direction or in a direction parallel to the header flow path 302.

The plurality of refrigerant outlet pipes 280, 282, 284 and 286 may guide the refrigerant of the header flow path 302 to the refrigerant flow path of the evaporator. One refrigerant outlet pipe may be connected to one refrigerant flow path of the evaporator, the plurality of refrigerant outlet pipes may be connected to one refrigerant flow path of the evaporator, and one refrigerant outlet pipe may be connected to the plurality of refrigerant flow paths of the evaporator. Hereinafter, for the convenience, it will be described that one refrigerant outlet pipe is connected to one refrigerant flow path of the evaporator. If the evaporator inlet header distributor is the evaporator inlet header distributor 5' connected to the first heat exchanger 2, the plurality of refrigerant outlet pipes 280, 282, 284 and 286 may be each connected to the plurality of refrigerant flow paths 21, 22, 23 and 24 of the first heat exchanger 2. In the evaporator inlet header distributor 5', one refrigerant outlet pipe may be connected to each refrigerant flow path of the first heat exchanger 2. If the evaporator inlet header distributor is the evaporator inlet header distributor 5 connected to the second heat exchanger 4, the plurality of refrigerant outlet pipes 280, 282, 284 and 286 may be connected each to the plurality of refrigerant flow paths 41, 42, 43 and 44 of the second heat exchanger 4. In the evaporator inlet header distributor 5, one refrigerant outlet pipe may be connected each to one refrigerant flow path of the second heat exchanger 4.

The plurality of refrigerant outlet pipes 280, 282, 284 and 286 may be installed by penetrating the header flow path 302. The plurality of refrigerant outlet pipes 280, 282, 284 and 286 may be installed to be separated from the header flow path 302. The plurality of refrigerant outlet pipes 280, 282, 284 and 286 may be inserted into the header flow path 302 of the distributor body 260. Each inlet stage 288 of the plurality of refrigerant outlet pipes 280, 282, 284 and 286 may be located on the header flow path P4, and each outlet stage 289 thereof may be located outside of the distributor body 260. The inlet stage 288 of each of the plurality of refrigerant outlet pipes 280, 282, 284 and 286 may be disposed to be opposed to an inner wall of the header flow path 302. The plurality of refrigerant outlet pipes 280, 282, 284 and 286 may extend in a direction substantially orthogonal to a longitudinal direction of the header flow path 302. The plurality of refrigerant outlet pipes 280, 282, 284 and 286 may be installed to have a height difference in the header flow path 302. An uppermost side refrigerant outlet pipe 280 in the plurality of refrigerant outlet pipes 280, 282, 284 and 286 may have a height lower than a top of the header flow path 302, or a height equal to a top of the header flow path 302. The lowest side refrigerant outlet pipe 286 of the plurality of refrigerant outlet pipes 280, 282, 284 and 286 may have a height higher than a bottom of the header flow path 302, or a height equal to a bottom of the header flow path 302.

Hereinafter, operation of an evaporator inlet header distributor configured as described above will be described as follows.

First, when performing the heating operation of the air conditioner, gaseous refrigerant at a high-temperature and high-pressure may be discharged from the compressor 1 and may be condensed in the first heat exchanger 2, which may function as a condenser. The refrigerant condensed in the first heat exchanger 2 may be expanded by the expansion mechanism 3, and the two-phase refrigerant of liquid refrigerant and gaseous refrigerant may flow into the evaporator inlet refrigerant distributor 5 connected to the second heat exchanger 4, which may function as an evaporator. The two-phase refrigerant having flowed into the evaporator inlet refrigerant distributor 5 may flow into the distributor body 260 through the refrigerant inlet pipe 270, and the refrigerant introduced into the distributor body 260 may flow in an upward direction while passing along the inner flow path P4 of the header flow path 302. At this time, some of the refrigerant may be discharged into the plurality of refrigerant outlet pipes 280, 282, 284 and 286 through inlet stage 288 of the plurality of refrigerant outlet pipes 280, 282, 284 and 286, and the rest of two-phase refrigerant may be introduced into inner flow path P5 of the return flow path

304. The refrigerant introduced into the inner flow path P5 flows along the return flow path P5, and then, may be again introduced into the inner flow path P4 of the header flow path 302. At this time, the refrigerant may be mixed with two-phase refrigerant newly introduced through the outlet stage 272 of the refrigerant inlet pipe 270 and may again flow into the inner flow path P4 of the header flow path 302. As such, if the two-phase refrigerant is re-introduced into the header flow path 302 through the return flow path 304, the air conditioner may uniformly distribute the two-phase refrigerant to the plurality of refrigerant outlet pipes 280, 282, 284 and 286, without concentrating liquid refrigerant to the upper portion of the header flow path 302.

When performing the cooling operation of the air conditioner, gaseous refrigerant at a high-temperature and high-pressure may be discharged from the compressor 1 and may be condensed in the second heat exchanger 4, which may function as a condenser. The refrigerant condensed in the second heat exchanger 4 may be expanded in the expansion mechanism 3, and the two-phase refrigerant of liquid refrigerant and gaseous refrigerant may flow into the evaporator inlet refrigerant distributor 5' connected to the first heat exchanger 2, which may function as an evaporator. Of the two-phase refrigerant having flowed into the evaporator inlet refrigerant distributor 5' connected to the first heat exchanger 2, the refrigerant which is not introduced into the plurality of refrigerant outlet pipes 280, 282, 284 and 286 may be introduced into the inner flow path P4 of the header flow path 302 through the inner flow path P5 of the return flow path 304, as when performing the heating operation of the air conditioner, and the two-phase refrigerant may be uniformly distributed into the plurality of refrigerant outlet pipes 280, 282, 284 and 286. The two-phase refrigerant may be uniformly evaporated in the plurality of refrigerant flow paths 21, 22, 23 and 24 of the evaporator. The refrigerant evaporated in each of the plurality of refrigerant flow paths 21, 22, 23 and 24 may be introduced into the evaporator outlet header pipe 6' connected to the first heat exchanger 2, which may function as an evaporator, and may be again mixed in the evaporator outlet header pipe 6'. Then, the refrigerant may again flow into the compressor 1, and the compressor 1 may compress the refrigerant evaporated in the first heat exchanger 2, which may function as an evaporator.

Figure 8:
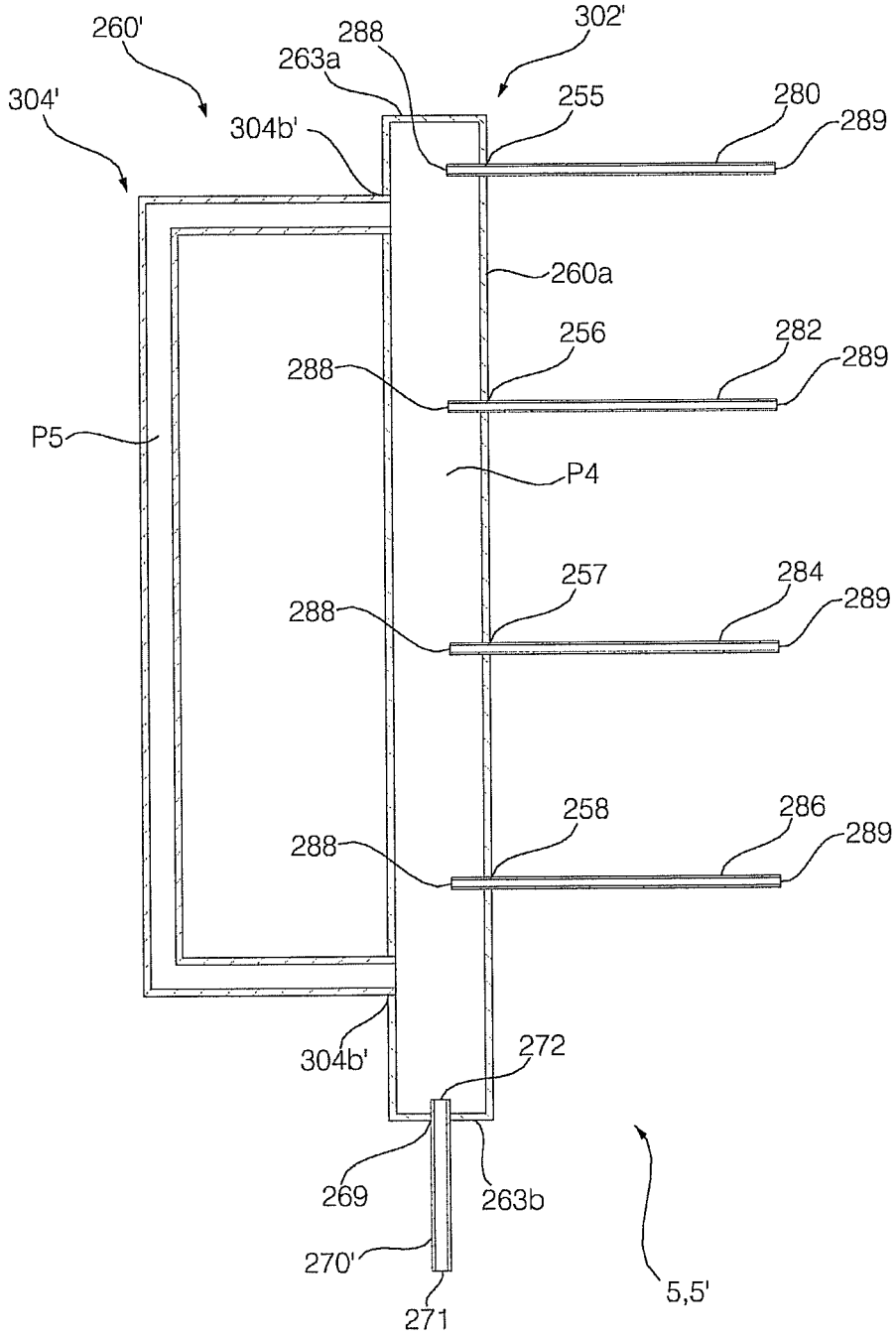
FIG. 8 is a schematic internal cross-sectional diagram of an evaporator inlet header distributor in an air conditioner according to another embodiment.

FIG. 8 a schematic internal cross-sectional diagram of an evaporator inlet header distributor in an air conditioner according to another embodiment. In the air conditioner according to this embodiment, the distributor body 260' may include a header flow path 302' and a return flow path 304', and the refrigerant inlet pipe 270' and the plurality of refrigerant outlet pipes 280, 282, 284 and 286 may be connected to the header flow path 302'.

The header flow path 302' may be configured as a header pipe in which a top and bottom thereof may be closed and the inner flow path P4 may be formed inside thereof. The inner flow path P4 may extend in a substantially vertical or up and down direction and a top and bottom thereof may be closed. The header flow path 302' may include a pipe 260*a*, an upper plate 263*a* which closes a top of the pipe 260*a*, and a lower plate 263*b* which closes a bottom of the pipe 260*a*. The plurality of refrigerant outlet pipe penetration holes 255, 256, 257 and 258 may be formed in the pipe 260*a*. The refrigerant suction line penetration hole 269 may be formed in the lower plate 263*b*.

In the return flow path 304', an upper portion 304*a*' may be connected to an upper portion of the pipe 260*a* in the header flow path 302', and a lower portion 304*b*' may be connected to a lower portion of the pipe 260*a* of the header pipe 302' or the lower plate 263*b*. In the return flow path 304', the inner flow path P5 may be in the form of a 'ㄷ' shape or 'C' shape. In the return flow path 304', the upper portion 304*a*' may be connected to a location lower than an uppermost side refrigerant outlet pipe 280 of the plurality of refrigerant outlet pipes 280, 282, 284 and 286.

In the refrigerant inlet pipe 270', only the installation location thereof may be different from the previous embodiment, the configuration and operation may be identical or similar to the previous embodiments, and repetitive description has been omitted.

Figure 9:
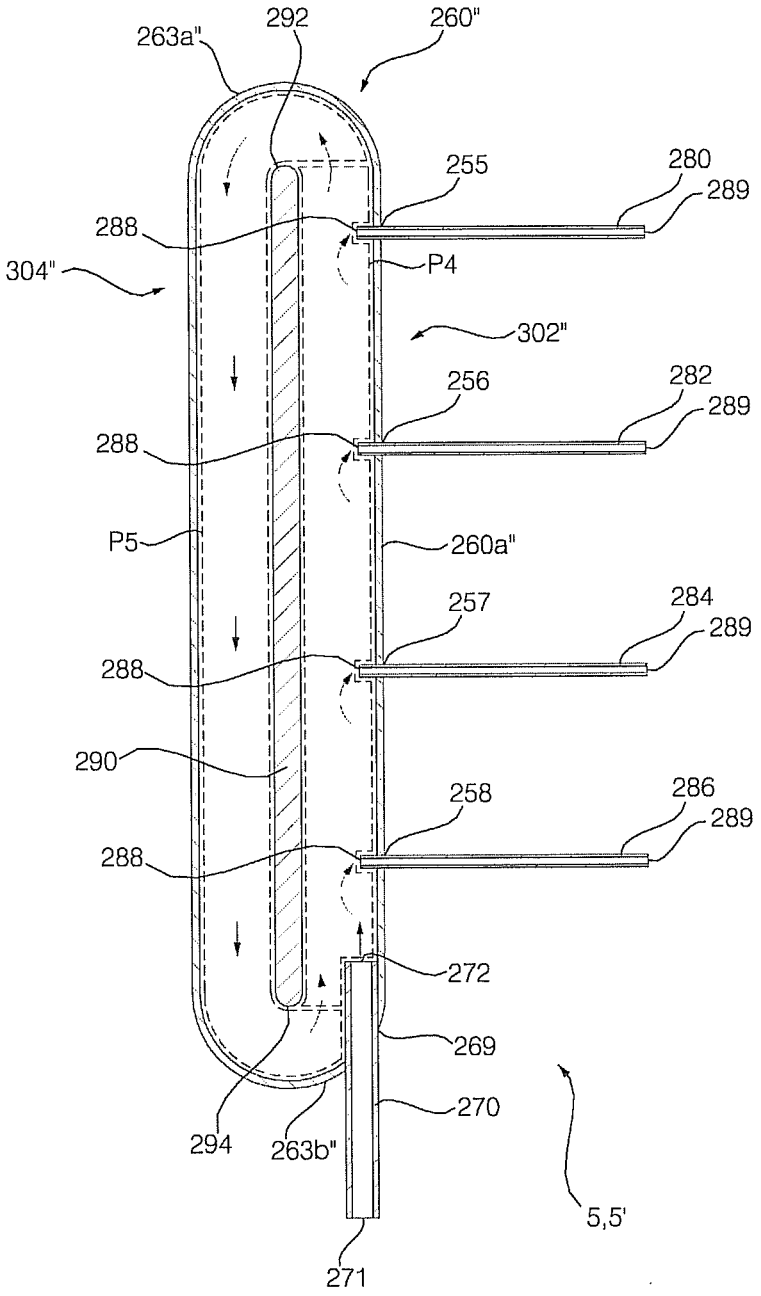
FIG. 9 is a schematic internal cross-sectional diagram of an evaporator inlet header distributor in an air conditioner according to another embodiment.

FIG. 9 is a schematic internal cross-sectional diagram of an evaporator inlet header distributor in an air conditioner according to another embodiment. With the air conditioner according to this embodiment, a separating plate 290 may be disposed in a distributor body 260" in which a header flow path 302" and a return flow path 304" are divided, and a top 292 of the separating plate 290 may be separated from a top of the distributor body 260". In addition, a bottom 294 of the separating plate 290 may be separated from a bottom of the distributor body 260". As the configuration and operation, except for the distributor body 260" and the separating plate 290, are identical or similar to the previous embodiment, repetitive description has been omitted.

The distributor body 260" may extend in the air conditioner in a substantially vertical or up and down direction. In the distributor body 260", the pipe 260*a*" may extend in the substantially vertical or up and down direction, and upper portion 263*a*" and lower portion 263*b*" may be roundly formed. The pipe 260*a*" may extend in the up and down direction, the upper portion 263*a*" may be formed on a top of the pipe 260*a*", and the lower portion 263*b*" may be formed on a bottom of the pipe 260*a*". The pipe 260*a*" may be in the form of a hollow cylindrical shape or a hollow square bucket shape. In the distributor body 260", if the upper portion 263*a*" and the lower portion 263*a*" are roundly formed, the two-phase refrigerant of the header flow path P4 may be easily returned to the inner flow path P4 by rotating along the inner flow path P5, the upper portion 263*a*", and the lower portion 263*b*" of the distributor body 260". The plurality of refrigerant outlet pipe penetration holes 255, 256, 257 and 258, through which the plurality of refrigerant outlet pipes 280, 282, 284 and 286 may penetrate may be formed, and the refrigerant inlet pipe penetration hole 269, through which the refrigerant inlet pipe 270 may penetrate.

The outlet stage 272 of the refrigerant inlet pipe 270 may be disposed to guide the refrigerant to the inside of the header flow path 302". The refrigerant inlet pipe 270 may penetrate the lower portion 263*b*" of the distributor body 260", and the refrigerant inlet pipe penetration hole 269 may be formed on the lower portion 263*b*" of the distributor body 260" in the substantially vertical or up and down direction. The inlet stage 288 of the plurality of refrigerant outlet pipes 280, 282, 284, 286 may be installed to face the separating plate 290.

The separating plate 290 may separate the inside of the distributor body 260" into the inner flow path P4 and the inner flow path P5. A side of the separating plate 290 at which the plurality of refrigerant outlet pipes 280, 282, 284 and 284 in the pipe 261" penetrate may be the inner path P4. A side of the separating plate 290 opposed to the plurality of refrigerant outlet pipes 280, 282, 284 and 284 may form the inner flow path P5. A top of the header flow path P4 may be connected with the inner flow path P5, and a bottom thereof may be connected with the inner flow path P5. A cross-sectional shape of an upper portion of the inner flow path P5 may be connected with the inner flow path P4 in the form of a '∩' shape, and a cross-sectional shape of a lower portion thereof may be connected with the header flow path P4 in the form of the '∪' shape.

Figure 10:
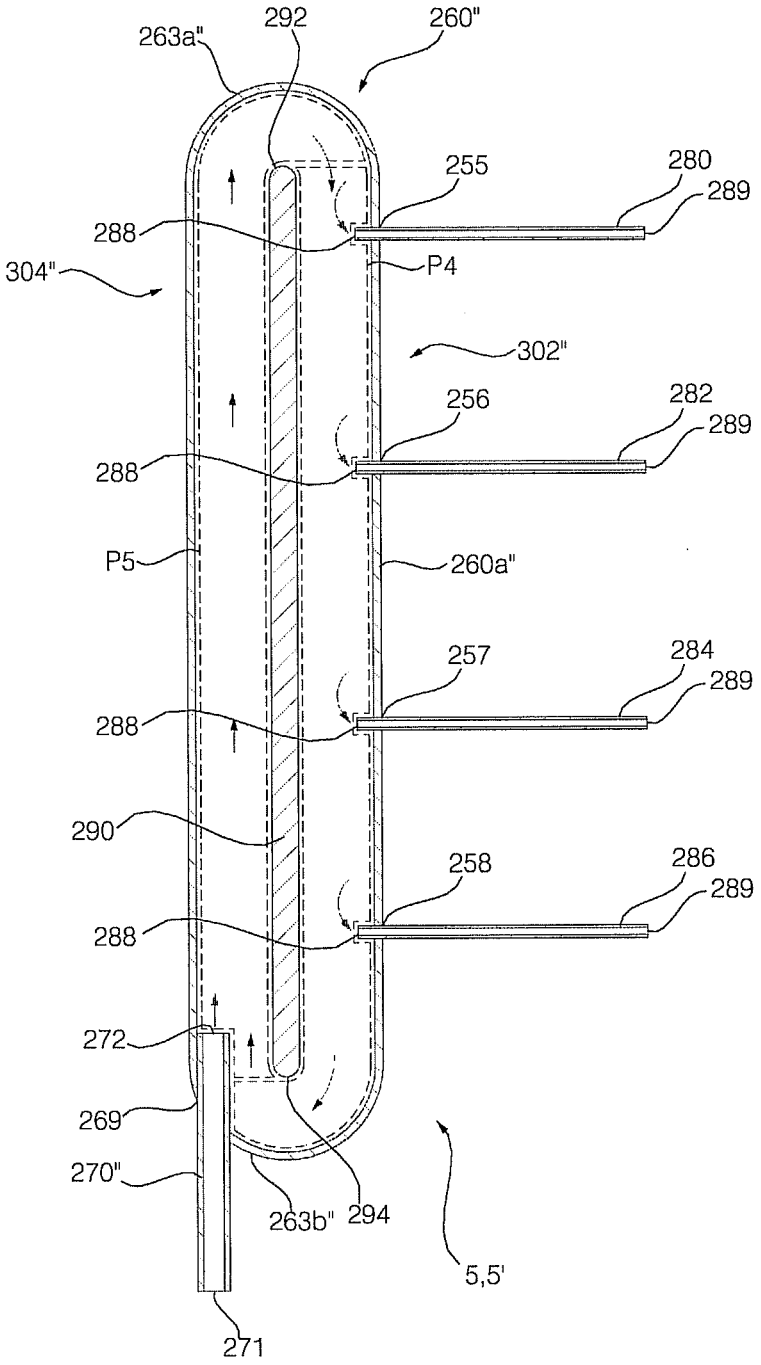
FIG. 10 is a schematic internal cross-sectional diagram of an evaporator inlet header distributor in an air conditioner according to another embodiment.

FIG. 10 is a schematic internal cross-sectional diagram of an evaporator inlet header distributor in an air conditioner according to an another embodiment. In the air conditioner according to this embodiment, the separating plate 290 may be disposed in the distributor body 260" and the outlet stage 272 of the refrigerant inlet pipe 270" may be disposed to guide the refrigerant to flow to the return flow path 304", and as the configuration and operation of the air conditioner of this embodiment is identical or similar to the previous embodiment, except for the outlet stage 272 of the refrigerant outlet pipe 270, like reference numerals may be used, and repetitive description has been omitted. The distributor body 260" and the plurality of refrigerant outlet pipes 280, 282, 284 and 284 may be configured as in the previous embodiment.

In the refrigerant inlet pipe 270", the outlet stage 272 may be installed to be connected with the return flow path P5; the two-phase refrigerant may be firstly introduced into the return flow path P5 through the outlet stage 272 of the refrigerant inlet pipe 270". The two-phase refrigerant introduced into the return flow path P5 may flow along the return flow path P5 in an upper direction and pass between a top 292 of the separating plate 290 and an upper portion 263*a*" of the distributor body 260", and then, may flow into the header flow path P4. A portion of the refrigerant having flowed into the header flow path P4 may be distributed into the plurality of refrigerant outlet pipes 280, 282, 284 and 286, and the rest may be flow into a lower side of the header flow path P4. The two-phase refrigerant having flowed into the lower side of the header flow path P4 may be pass between a bottom 294 of the separating plate 290 and a lower portion of the distributor body 260" and then, may be mixed with the two-phase refrigerant newly introduced through the outlet stage 272 of the refrigerant inlet pipe 270" in a vicinity of the outlet stage 272 of the refrigerant inlet pipe 270". The mixed two-phase refrigerant may flow to an upper portion of the return flow path P5. As the two-phase refrigerant circulates along the return flow path P5 and the header flow path P4, the liquid refrigerant may not be concentrated to the upper portion or lower portion of the header flow path P4, and the two-phase refrigerant may be uniformly distributed into the plurality of refrigerant outlet pipes 280, 282, 284 and 286.

Embodiments disclosed herein provide an air conditioner in which a two-phase refrigerant of liquid refrigerant and gaseous refrigerant may be dispersed in a substantially vertical or up and down direction, and flowed into a plurality of refrigerant outlet pipes, and thus, the two-phase refrigerant may be uniformly distributed to the plurality of refrigerant outlet pipes.

An air conditioner according to embodiments disclosed herein may include an evaporator in which a plurality of refrigerant flow paths are formed to evaporate a refrigerant, a compressor to compress the refrigerant evaporated in the evaporator, a condenser to condense the refrigerant compressed in the compressor, an expansion mechanism to expand the refrigerant condensed in the condenser, and an evaporator inlet header distributor to distribute the refrigerant expanded in the expansion mechanism to the plurality of refrigerant flow paths. The evaporator inlet header distributor may include a distributor body, a refrigerant inlet pipe to guide the refrigerant expanded in the expansion mechanism to an inside of the distributor body, a plurality of refrigerant outlet pipes to discharge the refrigerant of the distributor body into the plurality of refrigerant flow paths, and a separating plate to separate the inside of the distributor body into a header flow path connected with the plurality of refrigerant outlet pipes and a refrigerant dispersing flow path connected with the refrigerant inlet pipe to guide an upper portion and a lower portion of the header flow path by dispersing the refrigerant.

The header flow path and the refrigerant dispersing flow path may be each connected at an upper side and a lower side thereof. The separating plate may have a top that is separated from a top of the distributor body, and a bottom that is separated from a bottom of the distributor body A single refrigerant inlet pipe may be connected to one side of left and right sides of the distributor body, and the plurality of refrigerant outlet pipes may penetrate at the other side of left and right sides of the distributor body, based on a vertical center axis of the distributor body. The refrigerant inlet pipe may have an outlet stage installed to be opposite to the separating plate. The separating plate may be vertically disposed on the inside of the distributor body. The separating plate may have a distance from the refrigerant inlet pipe shorter than that from the plurality of refrigerant outlet pipes.

An air conditioner according embodiments disclosed herein may include an evaporator in which a plurality of refrigerant flow paths are formed to evaporate a refrigerant, a compressor to compress the refrigerant evaporated in the evaporator, a condenser to condense the refrigerant compressed in the compressor, an expansion mechanism to expand the refrigerant condensed in the condenser, and an evaporator inlet header distributor to distribute the refrigerant expanded in the expansion mechanism to the plurality of refrigerant flow paths. The evaporator inlet header distributor may include a distributor body formed with a header flow path in an inside thereof, a plurality of refrigerant outlet pipes to discharge the refrigerant of the distributor body into the plurality of refrigerant flow paths, a lower refrigerant inlet pipe to guide the refrigerant expanded in the expansion mechanism to a lower portion of the header flow path, and an upper refrigerant inlet pipe to guide the refrigerant expanded in the expansion mechanism to an upper portion of the header flow path. An outlet stage of the lower refrigerant inlet pipe and an outlet stage of the upper refrigerant inlet pipe may be disposed to face each other in a substantially vertical or up and down direction.

The lower refrigerant inlet pipe may be connected to a lower plate of the distributor body, and the upper refrigerant inlet pipe may be connected to an upper plate of the distributor body. The outlet stage of the lower refrigerant inlet pipe and the outlet stage of the upper refrigerant inlet pipe may be located at a vertical center axis of the distributor body.

Embodiments disclosed herein provide an advantage in that two-phase refrigerant may be uniformly distributed to the plurality of refrigerant outlet pipes using a simple structure. In addition, embodiments disclosed herein provide an advantage in that two-phase refrigerant may be dispersed and introduced into an upper portion and a lower portion of a header flow path in a substantially vertical or up and down direction, and thus, liquid refrigerant being concentrated to a portion of a plurality of refrigerant outlet pipes may be minimized.

In addition, embodiments disclosed herein provide an air conditioner in which it can be minimized that liquid refrigerant may be concentrated to a portion of the plurality of refrigerant flow paths of the evaporator and an overall efficiency of an evaporator may be improved.

An air conditioner according to embodiments disclosed herein may include an evaporator in which a plurality of refrigerant flow paths may be formed to evaporate a refrigerant, a compressor to compress the refrigerant evaporated in the evaporator, a condenser to condense the refrigerant compressed in the compressor, an expansion mechanism to expand the refrigerant condensed in the condenser, and an evaporator inlet header distributor to distribute the refrigerant expanded in the expansion mechanism to the plurality of refrigerant flow paths. The evaporator inlet header distributor may include a header body formed with a space in an inside thereof, a refrigerant inlet pipe to guide the refrigerant expanded in the expansion mechanism to a lower portion of the space and a plurality of refrigerant outlet pipes in which the refrigerant of the space is discharged to the refrigerant flow path, and the plurality of refrigerant outlet pipes may be each connected with a liquid refrigerant suction line to guide a liquid refrigerant of a lower portion of the space. The refrigerant inlet pipe may have an outlet stage that turns to a lower portion of an inner peripheral surface of the distributor body or an upper surface of a lower plate of the distributor body. The refrigerant inlet pipe may be obliquely disposed on the circumference portion of the distributor body.

The air conditioner may further include a partition wall installed in the space to separate a liquid refrigerant and a gaseous refrigerant. The partition wall may be disposed to have a gap from the inner peripheral surface of the distributor body, and the liquid refrigerant suction line may penetrate the gap. The partition wall may have a height from a lower plate of the distributor body higher than the outlet stage of the refrigerant inlet pipe.

The plurality of refrigerant outlet pipes may have an inlet stage of a refrigerant outlet pipe located on a lowest side that has a height from a lower plate of the distributor body higher than the partition wall. The plurality of refrigerant outlet pipes may be inserted into an upper portion of the space.

The liquid refrigerant suction lines may be connected to a location separated from an inlet stage of the refrigerant outlet pipe. The liquid refrigerant suction lines may have an internal cross-sectional area smaller than the refrigerant outlet pipe. A bottom of the liquid refrigerant suction lines may be separated from a lower plate of the distributor body. A top of the liquid refrigerant suction lines may be connected to a portion located on the inside of the distributor body of the refrigerant outlet pipes.

An end of the liquid refrigerant suction lines may connected to a lower plate of the distributor body or a lower portion of the circumference portion of the distributor body, and the other end of the liquid refrigerant suction lines may be connected to a portion located on the outside of the distributor body of the refrigerant outlet pipes.

Embodiments disclosed herein have advantages in that, as the two-phase refrigerant having flowed from the expansion mechanism into the evaporator inlet header distributor may be separated into gaseous refrigerant and liquid refrigerant, and the gaseous refrigerant suctioned into the refrigerant outlet pipes after being separated from the liquid refrigerant may be again mixed with the liquid refrigerant suctioned in the liquid refrigerant suction lines after being separated from the gaseous refrigerant, it may be minimized that the liquid refrigerant may be concentrated into a portion of the plurality of refrigerant flow paths of the evaporator, and two-phase refrigerant may be uniformly distributed into the plurality of refrigerant flow paths of the evaporator to increase the efficiency of the evaporator.

Embodiments disclosed herein provide an air conditioner forming a return flow path portion to guide the liquid refrigerant without being concentrated to one side.

An air conditioner according to embodiments disclosed herein may include an evaporator in which a plurality of refrigerant flow paths may be formed to evaporate a refrigerant, a compressor to compress the refrigerant evaporated in the evaporator; a condenser to condense the refrigerant compressed in the compressor, an expansion mechanism to expand the refrigerant condensed in the condenser, and an evaporator inlet header distributor to distribute the refrigerant expanded in the expansion mechanism to the plurality of refrigerant flow paths. The evaporator inlet header distributor may include a plurality of refrigerant outlet pipes connected to the refrigerant flow path, a distributor body having a header flow path to which the plurality of refrigerant outlet pipes may be connected, and a return flow path portion each connected to an upper side and a lower side of the header flow path portion to connect an upper side and a lower side of the header flow path portion, and a refrigerant inlet pipe to guide the refrigerant expanded in the expansion mechanism to one of the header flow path portion and the return flow path portion.

The refrigerant inlet pipe may be installed in a lower portion of the distributor body. The refrigerant inlet pipe may have an outlet stage formed on a top of the refrigerant inlet pipe to be turned to the header flow path portion.

The return flow path portion may guide the refrigerant having flowed into an upper side of the header flow path portion to a lower side to the header flow path portion. The distributor body may be formed with a separating plate in the inside thereof, the header flow path portion and the return flow path portion being divided by the separating plate.

The plurality of refrigerant outlet pipes may have an inlet stage installed to be opposite to the separating plate. A top of the separating plate may be separated from a top of the distributor body, and a bottom of the separating plate may be separated from a bottom of the distributor body. The return flow path portion may have an upper portion connected to a location lower than an uppermost side refrigerant outlet pipe of the plurality of refrigerant outlet pipes.

Embodiments disclosed herein advantage in that the return flow path portion connected with the header flow path portion may be formed in the distributor body to prevent the liquid refrigerant from being concentrated to the opposed side of the refrigerant inlet pipe in the header flow path portion. In addition, as the liquid refrigerant, which does not flow from the header flow path portion to the plurality of refrigerant outlet pipe, may flow into the return flow path portion, without congestion in the header flow path portion, and then may flow into the plurality of refrigerant outlet pipe while again passing the header flow path portion, it may be minimized that the liquid refrigerant is congested and accumulated in the distributor body, and heat-exchanging performance of the evaporator may be increased.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

an evaporator comprising a plurality of refrigerant flow paths that evaporates a refrigerant;

a compressor that compresses the refrigerant evaporated in the evaporator, a condenser that condenses the refrigerant compressed in the compressor;

an expansion valve that expands the refrigerant condensed in the condenser; and an evaporator inlet header distributor that distributes the refrigerant expanded in the expansion valve to the plurality of refrigerant flow paths, wherein the evaporator inlet header distributor comprises:

a distributor body having a space defined in an inside thereof;

a refrigerant inlet pipe that guides the refrigerant expanded in the expansion valve to a lower portion of the space; and a plurality of refrigerant outlet pipes having an inlet stage disposed in an upper portion of the space by which the refrigerant in the space is discharged to the plurality of refrigerant flow paths, wherein each of the plurality of refrigerant outlet pipes is connected with one of a plurality of liquid refrigerant suction lines at a position separate from the inlet stage of the plurality of refrigerant outlet pipes to guide liquid refrigerant disposed in the lower portion of the space to the plurality of refrigerant outlet pipes, respectively.

2. The air conditioner of claim 1, wherein the refrigerant inlet pipe has an outlet stage that is inclined toward to a lower portion of an inner peripheral surface of the distributor body or an upper surface of a lower plate of the distributor body.

3. The air conditioner of claim 2, wherein the refrigerant inlet pipe is obliquely disposed on a circumferential portion of the distributor body.

4. The air conditioner of claim 1, further comprising:

a partition wall installed in the space to separate liquid refrigerant and gaseous refrigerant.

5. The air conditioner of claim 4, wherein a gap is provided between the partition wall and an inner peripheral surface of the distributor body, and the plurality of liquid refrigerant suction lines penetrates the gap.

6. The air conditioner of claim 4, wherein a height of the partition wall from a lower plate of the distributor body is higher than an outlet stage of the refrigerant inlet pipe.

7. The air conditioner of claim 4, wherein an inlet stage of a refrigerant outlet pipe of the plurality of refrigerant outlet pipes located at a lowermost side has a height from a lower plate of the distributor body higher than the partition wall.

8. The air conditioner of claim 4, wherein the plurality of refrigerant outlet pipes communicates with the upper portion of the space.

9. The air conditioner of claim 1, wherein each of the plurality of liquid refrigerant suction lines has an internal cross-sectional area smaller than an internal cross-sectional area of the respective refrigerant outlet pipe.

10. The air conditioner of claim 1, wherein a bottom of each of the plurality of liquid refrigerant suction lines is separated from a lower plate of the distributor body.

11. The air conditioner of claim 1, wherein a top of each of the plurality of liquid refrigerant suction lines is connected to a portion of its respective refrigerant outlet pipe located inside of the distributor body.

12. The air conditioner of claim 1, wherein the distributor body includes:

a circumferential portion that extends in a substantially vertical direction;

an upper plate connected at a top of the circumferential portion; and a lower plate connected at a bottom of the circumferential portion.

13. The air conditioner of claim 12, wherein the circumferential portion of the distributor body is in a form of a hollow cylindrical shape or a hollow square bucket shape.

14. The air conditioner of claim 12, wherein the distributor body includes a refrigerant inlet pipe penetration hole, through which the refrigerant inlet pipe passes.

15. The air conditioner of claim 14, wherein the refrigerant inlet pipe penetration hole is formed in the circumferential portion of the distributor body.

16. The air conditioner of claim 12, wherein the distributor body includes a plurality of refrigerant outlet pipe penetration holes, through which the plurality of refrigerant outlet pipes passes, respectively.

17. The air conditioner of claim 16, wherein the plurality of refrigerant outlet pipe penetration holes is formed in the circumferential portion of the distributor body.

18. The air conditioner of claim 17, wherein the plurality of refrigerant outlet pipe penetration holes is formed to be vertically spaced away from each other, and wherein the plurality of refrigerant outlet pipes passes through the plurality of refrigerant outlet pipe penetration holes substantially parallel to each other.

19. The air conditioner of claim 18, wherein the position from the inlet stage of each of the plurality of refrigerant outlet pipes at which the respective liquid suction line is connected is different from each other.

20. The air conditioner of claim 19, wherein each of the plurality of liquid suction lines extends vertically parallel to each other toward the lower plate of the distributor body.

* * * * *